US010037873B2

(12) United States Patent
Wang et al.

(10) Patent No.: US 10,037,873 B2
(45) Date of Patent: Jul. 31, 2018

(54) AUTOMATIC DETERMINATION OF DEMULTIPLEXING MATRIX FOR ION MOBILITY SPECTROMETRY AND MASS SPECTROMETRY

(71) Applicant: Agilent Technologies, Inc., Santa Clara, CA (US)

(72) Inventors: Jun Wang, San Jose, CA (US); Ruwan T. Kurulugama, Livermore, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 362 days.

(21) Appl. No.: 14/873,363

(22) Filed: Oct. 2, 2015

(65) Prior Publication Data

US 2016/0172171 A1 Jun. 16, 2016

Related U.S. Application Data

(60) Provisional application No. 62/091,168, filed on Dec. 12, 2014.

(51) Int. Cl.
*H01J 49/00* (2006.01)
*H01J 49/40* (2006.01)

(52) U.S. Cl.
CPC ..... *H01J 49/0036* (2013.01); *H01J 49/004* (2013.01); *H01J 49/40* (2013.01)

(58) Field of Classification Search
CPC ..... H01J 49/0036; H01J 49/004; H01J 49/40
See application file for complete search history.

(56) References Cited

U.S. PATENT DOCUMENTS

| | | | | |
|---|---|---|---|---|
| 5,396,065 | A | 3/1995 | Myerholtz et al. | |
| 6,300,626 | B1 | 10/2001 | Brock et al. | |
| 2004/0183007 | A1 | 9/2004 | Belov et al. | |
| 2005/0001163 | A1 | 1/2005 | Belov et al. | |
| 2005/0230614 | A1* | 10/2005 | Glukhoy | H01J 49/0022 250/287 |
| 2006/0024720 | A1* | 2/2006 | McLean | B82Y 30/00 435/6.12 |
| 2008/0149821 | A1* | 6/2008 | Senko | G01N 30/8624 250/282 |
| 2013/0161506 | A1* | 6/2013 | Ugarov | G01N 27/62 250/282 |

OTHER PUBLICATIONS

European Search Report dated Apr. 21, 2016 from related European Application No. 15197601.6.

(Continued)

*Primary Examiner* — Jason McCormack
*Assistant Examiner* — Sean Luck

(57) ABSTRACT

Multiplexed ion mobility spectrometry (IMS), mass spectrometry (MS) such as time-of-flight mass spectrometry (TOFMS), or hybrid IM-MS is carried out on a sample, and the resulting measurement data are deconvoluted. A pulse sequence controlling ion pulsing is utilized in conjunction with the multiplexing. The pulse sequence may be modified based on the raw measurement data acquired. A demultiplexing matrix based on the modified pulse sequence is utilized to improve deconvolution.

20 Claims, 13 Drawing Sheets

(56) References Cited

OTHER PUBLICATIONS

Kimmel, Joel R., et al, Effects of Modulation Defects on Hadamard Transform Time-of-flight Mass Spectrometry (HT-TOFMS), Journal of American Society for Mass Spectrometry, 2003, pp. 278-286, vol. 14, Elsevier Science, Inc.
Zare, Richard N., et al, Hadamard Transform Time-of-Flight Mass Spectrometry: More Signal, More of the Time, Angewadte Chemie International Edition, 2003, pp. 30-35, vol. 42, No. 1, Wiley-VCH Verlag GmbH & Co.

* cited by examiner

AUTOMATIC DETERMINATION OF DEMULTIPLEXING MATRIX FOR ION MOBILITY SPECTROMETRY AND MASS SPECTROMETRY

RELATED APPLICATIONS

This application claims the benefit of U.S. Provisional Patent Application Ser. No. 62/091,168, filed Dec. 12, 2014, titled "AUTOMATIC DETERMINATION OF DEMULTIPLEXING MATRIX FOR ION MOBILITY SPECTROMETRY AND MASS SPECTROMETRY," the content of which is incorporated by reference herein in its entirety.

TECHNICAL FIELD

The present invention relates generally to ion mobility spectrometry (IMS), mass spectrometry (MS) including time-of-flight mass spectrometry (TOFMS), and ion mobility-mass spectrometry (IM-MS). The invention relates particularly to multiplexed techniques implemented in conjunction with IMS, MS, and IM-MS.

BACKGROUND

Ion mobility spectrometry (IMS) is a gas-phase ion separation technique in which ions become separated in time and space as they travel through a drift cell of known length containing a buffer gas of known composition, pressure and temperature. An IMS system in general includes an ion source, the drift cell, and an ion detector. The ion source ionizes molecules of a sample of interest and transmits the resulting ions into the drift cell. After traveling through the drift cell, the ions arrive at the ion detector. In low-field drift-time IMS techniques, ions travel through the drift cell under the influence of a uniform DC voltage gradient established by electrodes of the drift cell. While the electric field moves the ions through the drift cell, the ions experience a drag force due to collisions with the stationary buffer gas molecules in the drift cell. The drag force acts against the electrical force that moves the ions. The drag force experienced by an ion depends on its collision cross section (CCS or Ω), which is a function of the ion's size and shape (conformation), and on its electrical charge and (to a lesser extent) mass. Ions with larger CCSs are retarded more easily by collisions with the buffer gas. On the other hand, multiply charged ions move through the buffer gas more effectively than singly charged ions because multiply charged ions experience a greater force due to the electrical field. The different CCSs of the separated ions can be correlated to their differing gas-phase mobilities through the buffer gas by the well-known Mason-Schamp equation.

Moreover, the different drift times of the separated ions through the length of the drift cell can be correlated to their differing mobilities. As the separated ions arrive at the ion detector, the ion detector counts the ions and measures their arrival times. The ion detector outputs measurement signals to electronics configured for processing the output signals as needed to produce a user-interpretable drift spectrum. The drift spectrum is typically presented as a plot containing a series of peaks indicative of the relative abundances of detected ions as a function of their drift time through the drift cell. The drift spectrum may be utilized to identify and distinguish different analyte species of the sample.

IMS may be coupled with one or more other types of separation techniques to increase compound identification power, such as gas chromatography (GC), liquid chromatography (LC), or mass spectrometry (MS). For example, an IMS drift cell may be coupled in-line with an MS system to form a combined IM-MS system. An MS system in general includes a mass analyzer for separating ions based on their differing mass-to-charge ratios (or m/z ratios, or more simply "masses"), followed by an ion detector. An MS analysis produces a mass spectrum, which is a series of peaks indicative of the relative abundances of detected ions as a function of their m/z ratios. The mass spectrum may be utilized to determine the molecular structures of components of the sample. An IM drift cell is often coupled to a time-of-flight mass spectrometer (TOFMS), which utilizes a high-resolution mass analyzer (TOF analyzer) in the form of an electric field-free flight tube. An ion extractor (or pulser) injects ions in pulses (or packets) into the flight tube. Ions of differing masses travel at different velocities through the flight tube and thus separate (spread out) according to their differing masses, enabling mass resolution based on time-of-flight.

In a combined IM-MS system, the ion source is followed by the IM drift cell, which in turn is followed by the mass analyzer and then the ion detector. Thus, ions are separated by mobility prior to being transmitted into the MS where they are then mass-resolved. Performing the two separation techniques in tandem is particularly useful in the analysis of complex chemical mixtures, including biopolymers such as polynucleotides, proteins, carbohydrates and the like. For example, the added dimension provided by the IM separation may help to separate ions that are different from each other but present overlapping mass peaks. The data acquired from processing a sample through an IM-MS system may be multi-dimensional, typically including ion abundance, acquisition time (or retention time), ion drift time through the IM drift cell, and m/z ratio as resolved by the MS. This hybrid separation technique may be further enhanced by coupling it with LC, thus providing an LC-IM-MS system.

Overlapping (or intermingling) between sequentially adjacent ion packets in the IM drift cell or TOF flight tube occurs when the slower ions of one ion packet are overtaken by faster ions of a subsequently injected ion packet. Consequently, ions from different ion packets arrive at the ion detector at the same instant of time, even though such ions have different mobilities and/or m/z ratios. The resulting measurement data acquired by the ion detector are convoluted, making the drift spectra and/or mass spectra difficult to interpret. Conventionally, this problem is avoided by operating IMS and TOFMS systems according to a "pulse and wait" approach, in which the injection rate of ion packets into the IM drift cell or the TOF flight tube is kept low enough to avoid overlapping. For example, after injecting an ion packet, the next ion packet may not be injected until the first ion packet has reached the ion detector. The pulse and wait approach thus suffers from a low duty cycle, as well as excessive ion losses between injections (at the ion gate preceding the IM drift tube or the ion pulser preceding the TOF flight tube) and thus low instrument sensitivity, particularly when a continuous-beam ion source is utilized.

Multiplexing (multiplexed injection) techniques are being developed as an improvement over the pulse and wait approach. With multiplexing, also known as multi-pulsing or over-pulsing, the injection of ion packets into the IM drift cell or the TOF flight tube is done at a high enough rate that multiple ion packets are present in the IM drift cell or TOF flight tube at the same time. Multiplexing causes overlapping between ion packets. However, multiplexing techniques address the problem of convoluted measurement data by applying some form of a deconvolution (or demultiplexing) process to the measurement data, thereby enabling a single drift time spectrum or TOF spectrum to be recovered from the measurement data. Of particular interest are deconvolution techniques based on the Hadamard transform (HT), although other types of transforms may alternatively be utilized. As an example of a HT technique, the ion packets are injected according to a pseudo-random sequence (PRS) of binary 1 's and 0's, where the 1' s correspond to "gate-open" (injection) events and the 0's correspond to "gate-closed" periods of time. The PRS is then used to generate an N×N Hadamard matrix, where N is the number of binary elements of the PRS. The Hadamard matrix in turn is used to generate an inverse Hadamard matrix. The inverse Hadamard matrix is then applied to the convoluted measurement data to extract a single array (or vector) of data from which a single, deconvoluted (or demultiplexed) spectrum may be generated.

One problem observed in the application of transform-based deconvolution techniques is the presence of noise in the raw measurement data to be deconvoluted. These noise components can cause inaccuracies in the deconvoluted data and subsequently generated spectra. Therefore, there is a need for IMS, MS, and IM-MS systems, and data acquisition methods for IMS, MS, and IM-MS, capable of performing deconvolution with less sensitivity to noise.

SUMMARY

To address the foregoing problems, in whole or in part, and/or other problems that may have been observed by persons skilled in the art, the present disclosure provides methods, processes, systems, apparatus, instruments, and/or devices, as described by way of example in implementations set forth below.

According to one embodiment, a method for determining a demultiplexing matrix for use in deconvoluting ion measurement data includes: acquiring ion measurement data comprising positive-value data points and non-positive-value data points; arranging the ion measurement data into a raw data array comprising a pattern of the positive-value data points and the non-positive-value data points, wherein the pattern matches a pattern of ON pulses and OFF pulses of an initial pulse sequence such that the positive-value data points correspond to respective ON pulses and the non-positive-value data points correspond to respective OFF pulses; constructing a modified pulse sequence by replacing each ON pulse of the initial pulse sequence with a corresponding modified ON pulse, wherein each modified ON pulse has a value proportional to the value of the corresponding positive-value data point, and the modified pulse sequence comprises a pattern of modified ON pulses and OFF pulses that matches the pattern of ON pulses and OFF pulses of the initial pulse sequence; and constructing a demultiplexing matrix based on the modified pulse sequence.

According to another embodiment, a method for determining a demultiplexing matrix for use in deconvoluting ion measurement data includes: acquiring ion measurement data comprising positive-value data points and non-positive-value data points; arranging the ion measurement data into a raw data array comprising a pattern of the positive-value data points and the non-positive-value data points, wherein the pattern matches a pattern of ON pulses and OFF pulses of an initial pulse sequence such that the positive-value data points correspond to respective ON pulses and the non-positive-value data points correspond to respective OFF pulses; determining the number of positive-value data points in the raw data array; determining a data point sum by summing the values of the positive-value data points; determining a base abundance by dividing the data point sum by the number of positive-value data points; dividing the values of the positive-value data points by the base abundance to obtain respective modified ON pulses; constructing a modified pulse sequence by replacing each ON pulse of the initial pulse sequence with a corresponding modified ON pulse, wherein the modified pulse sequence comprises a pattern of modified ON pulses and OFF pulses that matches the pattern of ON pulses and OFF pulses of the initial pulse sequence; and constructing a demultiplexing matrix based on the modified pulse sequence.

According to another embodiment, a method for determining a demultiplexing matrix for use in deconvoluting spectral data includes: at a computing device comprising a processor and a memory: arranging ion measurement data into a raw data array comprising a pattern of positive-value data points and non-positive-value data points, wherein the pattern matches a pattern of ON pulses and OFF pulses of an initial pulse sequence such that the positive-value data points correspond to respective ON pulses and the non-positive-value data points correspond to respective OFF pulses; determining the number of positive-value data points in the raw data array; determining a data point sum by summing the values of the positive-value data points; determining a base abundance by dividing the data point sum by the number of positive-value data points; dividing the values of the positive-value data points by the base abundance to obtain respective modified ON pulses; constructing a modified pulse sequence by replacing each ON pulse of the initial pulse sequence with a corresponding modified ON pulse, wherein the modified pulse sequence comprises a pattern of modified ON pulses and OFF pulses that matches the pattern of ON pulses and OFF pulses of the initial pulse sequence; and constructing a demultiplexing matrix based on the modified pulse sequence.

According to another embodiment, a method for determining a demultiplexing matrix for use in deconvoluting spectral data includes: injecting ions into a spectrometer at a multiplexed injection rate according to an initial pulse sequence comprising a pattern of ON pulses and OFF pulses, wherein each ON pulse has a binary value of 1 and each OFF pulse has a binary value of 0; acquiring raw measurement data from the ions, wherein the raw measurement data are arranged as a raw data array comprising positive-value data points corresponding to respective ON pulses and non-positive-value data points corresponding to respective OFF pulses; determining the number of positive-value data points in the raw data array; determining a data point sum by summing the values of the positive-value data points; determining a base abundance by dividing the data point sum by the number of positive-value data points; dividing the values of the positive-value data points by the base abundance to obtain respective modified ON pulses; constructing a modified pulse sequence by replacing each ON pulse of the initial pulse sequence with a corresponding modified ON pulse, wherein the modified pulse sequence comprises a pattern of modified ON pulses and OFF pulses that matches the pattern of ON pulses and OFF pulses of the initial pulse sequence; and constructing a demultiplexing matrix based on the modified pulse sequence.

According to another embodiment, a method for deconvoluting ion measurement data includes: determining a demultiplexing matrix according to any of the methods disclosed herein; and applying the demultiplexing matrix to the raw data array to recover ion measurement data corresponding to a single pulsing event.

According to another embodiment, a spectrometry system is configured for performing all or part of any of the methods disclosed herein.

According to another embodiment, a spectrometry system includes: spectrometry system comprising: an ion analyzer; an ion detector configured for receiving ions from the ion analyzer; and a computing device configured for performing all or part of any of the methods disclosed herein.

According to another embodiment, a system for deconvoluting ion measurement data includes: a processor and a memory configured for performing all or part of any of the methods disclosed herein.

According to another embodiment, a computer-readable storage medium includes instructions for performing all or part of any of the methods disclosed herein.

According to another embodiment, a system includes the computer-readable storage medium.

According to various embodiments, a spectrometry system as disclosed herein may be ion mobility spectrometry (IMS) system, a time-of-flight mass spectrometry (TOFMS) system, or a hybrid ion mobility-mass spectrometry (IM-MS) system.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

Figure 1A:
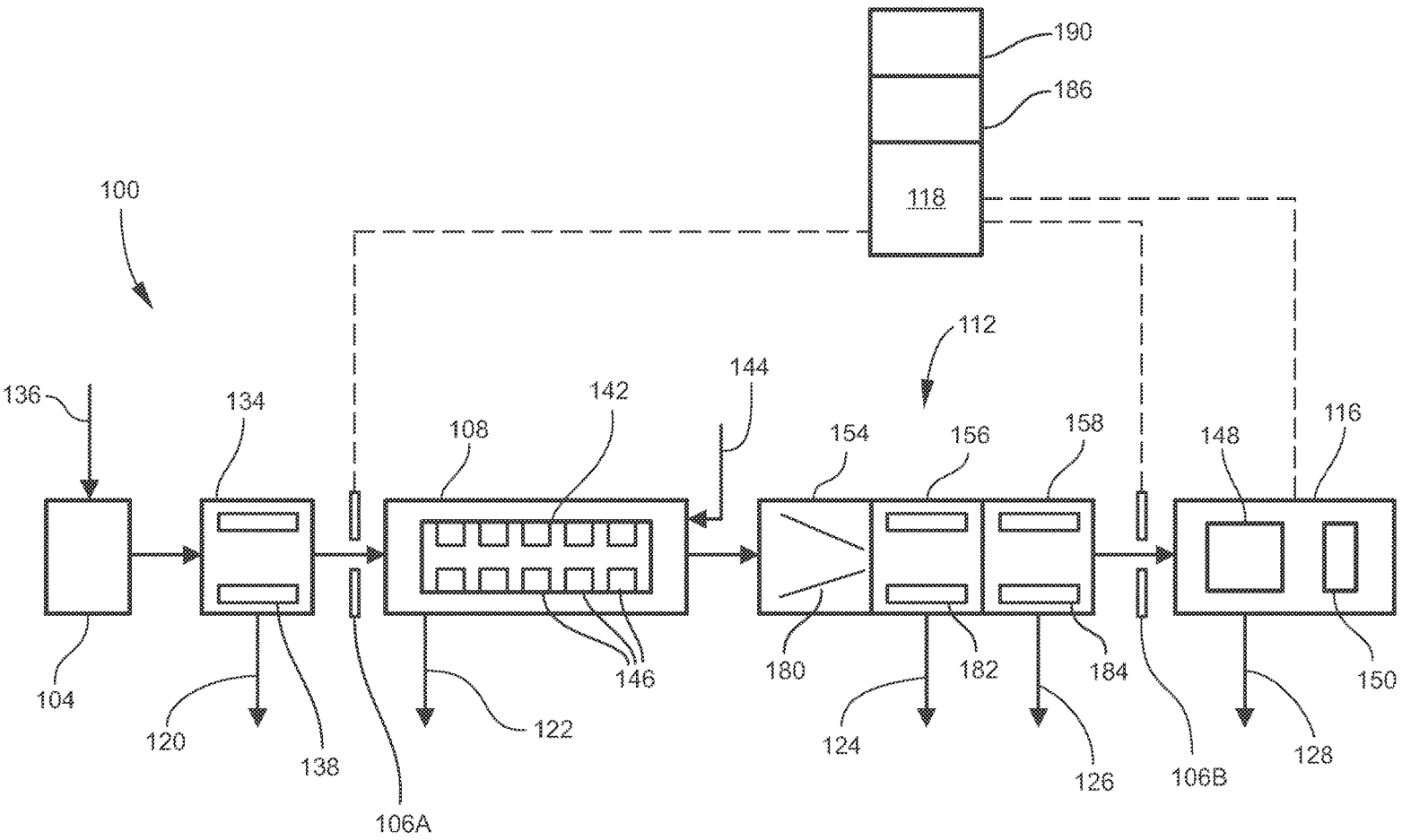
FIG. 1A is a schematic view of an example of a spectrometry system according to some embodiments, and which may be utilized in the implementation of the subject matter described herein.

FIG. 1A is a schematic view of an example of a spectrometry system 100 according to some embodiments, which may be utilized in the implementation of the subject matter described herein. The spectrometry system 100 may be an ion mobility spectrometry (IMS) system, a mass spectrometry (MS) system (particularly a time-of-flight mass spectrometry, or TOFMS, system), or a hybrid ion mobility mass spectrometry (IM-MS) system. The operation and design of various components of such spectrometry systems are generally known to persons skilled in the art and thus need not be described in detail herein. Instead, certain components are briefly described to facilitate an understanding of the subject matter presently disclosed. By example, the spectrometry system 100 specifically illustrated in FIG. 1A is described as an IM-MS system. Persons skilled in the art will readily recognize how the description of the IM-MS system may be modified so as to apply to an IMS system or a MS system.

The spectrometry system 100 may generally include an ion source 104, an ion mobility (IM) device 108, a mass spectrometer (MS) 116, and a computing device (or system controller) 118. The MS 116 may be considered as including or communicating with an ion detector 150. The spectrometry system 100 also includes an ion gate 106 (106A or 106B) between the ion source 104 and the ion detector 150. In some embodiments, the ion gate 106 may be positioned just upstream of the IM device 108. This position is schematically depicted as ion gate 106A. In other embodiments in which the IM device 108 is not included (or is not operated as a drift cell), the ion gate 106 may be positioned just upstream of, or is integrated with, the entrance into the MS 116, such as the ion extractor (ion pulser) of a time-of-flight (TOF) analyzer, i.e., the device functioning to inject ion packets into the flight tube of a TOF analyzer. This position is schematically depicted as ion gate 106B. In some embodiments, the spectrometry system 100 may include a device or means for accumulating ions, such as an ion trap 134, between the ion source 104 and the MS 116 (or between the ion source 104 and the IM device 108, if provided). Depending on the configuration of the ion trap 134, the ion gate 106 may be part of the ion trap 134, or may be a distinct device that is downstream from the output of the ion trap 134, as appreciated by persons skilled in the art.

The spectrometry system 100 also includes a vacuum system for maintaining various interior regions of the spectrometry system 100 at controlled, sub-atmospheric pressure levels. The vacuum system is schematically depicted by vacuum lines 120-128. The vacuum lines 120-128 are schematically representative of one or more vacuum-generating pumps and associated plumbing and other components appreciated by persons skilled in the art. The vacuum lines 120-128 may also remove any residual non-analytical neutral molecules from the ion path through the spectrometry system 100.

The ion source 104 may be any type of continuous-beam or pulsed ion source suitable for producing analyte ions for spectrometry. Examples of ion sources 104 include, but are not limited to, electron ionization (EI) sources, chemical ionization (CI) sources, photo-ionization (PI) sources, electrospray ionization (ESI) sources, atmospheric pressure chemical ionization (APCI) sources, atmospheric pressure photo-ionization (APPI) sources, field ionization (FI) sources, plasma or corona discharge sources, laser desorption ionization (LDI) sources, and matrix-assisted laser desorption ionization (MALDI) sources. In some embodiments, the ion source 104 may include two or more ionization devices, which may be of the same type or different type. Depending on the type of ionization implemented, the ion source 104 may reside in a vacuum chamber or may operate at or near atmospheric pressure. Sample material to be analyzed may be introduced to the ion source 104 by any suitable means, including hyphenated techniques in which the sample material is an output 136 of an analytical separation instrument such as, for example, a gas chromatography (GC) or liquid chromatography (LC) instrument (not shown). In some embodiments in which the ion source 104 is configured for outputting pulses or packets of ions, the ion source 104 may provide ion accumulating functionality in which case, at least in some embodiments, the ion trap 134 may not be included. As another alternative, the ion trap 134 may be configured for performing ionization (in-trap ionization). Thus, in some embodiments the ion source 104 and the ion trap 134 may be considered as being the same instrument.

The ion trap 134 generally may have any configuration suitable for stably accumulating ions of a desired mass range for a desired period of time, and then releasing ions upon command. The ion trap 134 may, for example, include a plurality of trap electrodes 138 enclosed in a chamber or housing. The chamber may communicate with a vacuum pump that maintains the ion trap 134 at a low pressure (e.g., 1 to 20 Torr). The trap electrodes 138 may be arranged about a trap axis and surround an interior region (trap interior) in which ions may be confined. The trap electrodes 138 are in signal communication with an appropriate voltage source, which includes a radio frequency (RF) voltage source and may also include a direct current (DC) voltage source. In response to applying an RF voltage of appropriate parameters (RF drive frequency and magnitude), or both an RF voltage and a DC voltage of appropriate magnitude superposed on the RF voltage, the trap electrodes 138 generate a two-dimensional RF (or RF/DC) trapping field that confines ions of a desired mass range (m/z range) to the trap interior for a desired period of time. The ion trap 134 may be operated to accumulate ions and thereafter pulse (or eject) the ions out to the MS 116 (or first to the IM device 108, if provided) in ion packets. Depending on the type of ion trap 134, the ion trap 134 may eject ions by modifying the RF voltage, applying additional RF or alternating current (AC) voltages, applying a DC voltage or voltages to one or more ion optics components, etc. In some embodiments, the trap electrodes 138 may be arranged in a three-dimensional or two-dimensional quadrupole configuration, as appreciated by persons skilled in the art. In other embodiments, the trap electrodes 138 may be ring-shaped electrodes or plates with apertures that are axially spaced along the trap axis. In other embodiments, the trap electrodes 138 may be configured as an ion funnel in which the funnel electrodes (typically ring-shaped) define a converging volume as appreciated by persons skilled in the art. Examples of ion funnels, including ion funnels configured as ion traps, are described in U.S. patent application Ser. No. 13/906,095, filed May 30, 2013, and titled "ION MOBILITY SPECTROMETRY-MASS SPECTROMETRY (IMS-MS) WITH IMPROVED ION TRANSMISSION AND IMS RESOLUTION," and U.S. Pat. No. 8,324,565, the entire contents of both of which is incorporated by reference herein.

The ion gate 106 generally may have any configuration suitable for pulsing an ion beam in an on/off manner, such as by deflecting, chopping, etc. For this purpose, the ion gate 106 may include one or more ion optics components such as electrodes, lenses, meshes, grids, etc. In some embodiments, the ion gate 106 may be or include a Bradbury-Nielsen gate, the configuration and operation of which are known to persons skilled in the art. Preferably, the ion gate 106 is a fast acting device capable of "opening" and "closing" on the microsecond (μs) scale. While FIG. 1A illustrates the ion gate 106 (ion gate 106A) as a separate component, in some embodiments the ion gate 106 may be integrated with the ion trap 134 (or with an appropriately configured ion source 104). That is, the ion trap 134 or the ion source 104 may be configured to provide the pulsed ion release function, i.e., serve as the ion gate.

The IM device 108 may generally include an IM drift cell (or drift tube) 142 enclosed in a chamber. The chamber communicates with a vacuum pump that maintains the drift cell 142 at a buffer gas (drift gas) pressure ranging from, for example, 1 to 760 Torr. A gas inlet 144 directs an inert buffer gas (e.g., nitrogen) into the drift cell chamber. The drift cell 142 includes a series of drift cell electrodes 146 (typically ring-shaped) spaced along the axis. The drift cell electrodes 146 are in signal communication with a voltage source to generate a DC voltage gradient (e.g., 10 to 20 V/cm) along the axis. As noted above, the axial DC voltage gradient moves the ions through the drift cell 142 in the presence of the buffer gas, whereby the ions become separated in time and space based on their different mobilities through the buffer gas. The DC voltage gradient may be generated in a known manner, such as by applying a voltage between the first and last drift cell electrodes 146, and through a resistive divider network between the first and last drift cell electrodes 146, such that successively lower voltages are applied to the respective drift cell electrodes 146 along the length of the drift cell 142.

The MS 116 may generally include a mass analyzer 148 and an ion detector 150 enclosed in a housing. The vacuum line 128 maintains the interior of the MS 116 at very low (vacuum) pressure (e.g., ranging from $10^{-4}$ to $10^{-9}$ Torr). The mass analyzer 148 separates analyte ions on the basis of their different mass-to-charge (m/z) ratios. In some embodiments, the mass analyzer 148 is a TOF analyzer, which separates analyte ions on the basis of their different m/z ratios as derived from their different times-of-flight. The TOF analyzer includes an ion pulser (or extractor) and an electric field-free flight tube. Entrance optics direct the ion beam into the ion pulser, which pulses the ions into the flight tube as ion packets. The ions drift through the flight tube toward the ion detector 150. Ions of different masses travel through the flight tube at different velocities and thus have different overall times-of-flight, i.e., ions of smaller masses travel faster than ions of larger masses. Each ion packet spreads out (is dispersed) in space in accordance with the time-of-flight distribution. The ion detector 150 detects and records the time that each ion arrives at (impacts) the ion detector 150. The ion detector 150 may be configured for transmitting ion measurement data to the computing device 118. A data acquisition process of the computing device 118 correlates the recorded times-of-flight with m/z ratios. The ion detector 150 may be any device configured for collecting and measuring the flux (or current) of mass-discriminated ions outputted from the mass analyzer 148. Examples of ion detectors 150 include, but are not limited to, multi-channel detectors (e.g., micro-channel plate (MCP) detectors), electron multipliers, photomultipliers, image current detectors, and Faraday cups. In some embodiments, the ion pulser accelerates the ion packets into the flight tube in a direction orthogonal to the direction along which the entrance optics transmit the ions into the ion pulser, which is known as orthogonal acceleration TOF (oa-TOF). In this case, the flight tube often includes an ion mirror (or reflectron) to provide a 180° reflection or turn in the ion flight path for extending the flight path and correcting the kinetic energy distribution of the ions.

In other embodiments in which the IM device 108 is included, the mass analyzer 148 may be a type other than a TOF analyzer. Examples of other types of mass analyzers include, but are not limited to, multipole electrode structures (e.g., quadrupole mass filters, linear ion traps, three-dimensional Paul traps, etc.), electrostatic traps (e.g. Kingdon, Knight and ORBITRAP® traps), and ion cyclotron resonance (ICR) or Penning traps such as utilized in Fourier transform ion cyclotron resonance mass spectrometry (FT-ICR or FTMS).

In some embodiments, the spectrometry system 100 may also include an ion processing section 112 generally serving as an interface (or an intermediate section or region) between the IM device 108 and the MS 116, i.e., between the exit of the IM drift cell 142 and the entrance of the mass analyzer 148. Generally, the ion processing section 112 may be considered as being configured for receiving the ions eluting from the drift cell 142 and transferring the ions to the MS 116. The ion processing section 112 may include one or more components (structures, devices, regions, etc.) positioned between the drift cell 142 and the MS 116. These components may serve various functions such as, for example, pressure reduction, neutral gas removal, ion beam focusing/guiding, ion filtering/selection, ion fragmentation, etc. The ion processing section 112 may include a housing enclosing one or more chambers. Each chamber may provide an independently controlled pressure stage, while appropriately sized apertures are provided at the boundaries between adjacent chambers to define a pathway for ions to travel through the ion processing section 112 from one chamber to the next chamber. Any of the chambers may include one or more ion guides, ion optics etc. By way of example, in the illustrated embodiment the ion processing section 112 includes a front (or first) chamber 154, a middle (or second) chamber 156, and a rear (or third) chamber 158 respectively containing an ion funnel 180, a first multipole ion guide 182, and a second multipole ion guide 184.

In some embodiments the MS 116 in combination with the ion processing section 112 (or a portion thereof) may form a tandem MS or $MS^n$ system. As an example, the first multipole ion guide 182 may be configured as a (typically quadrupole) mass filter for selecting ions of a specific m/z ratio or m/z ratio range, and the second multipole ion guide 184 may be configured as a non-mass-resolving, RF-only collision cell for producing fragment ions by collision-induced dissociation (CID) as appreciated by persons skilled in the art. Thus, in some embodiments the MS system 100 may be considered as including a QqQ, qTOF, or QqTOF instrument.

In FIG. 1A, the computing device 118 is schematically depicted as representing one or more modules (or units, or components) configured for controlling, monitoring and/or timing various functional aspects of the spectrometry system 100 such as, for example, the ion source 104, the ion gate 106, the IM device 108, and the MS 116, as well as any vacuum pumps, ion optics, upstream LC or GC instrument, sample introduction device, etc., that may be provided in the spectrometry system 100 but not specifically shown in FIG. 1A. One or more modules (or units, or components) may be, or be embodied in, for example, a desktop computer, laptop computer, portable computer, tablet computer, handheld computer, mobile computing device, personal digital assistant (PDA), smartphone, etc. The computing device 118 may also schematically represent all voltage sources not specifically shown, as well as timing controllers, clocks, frequency/waveform generators and the like as needed for applying voltages to various components of the spectrometry system 100. The computing device 118 may also be configured for receiving the ion detection signals from the ion detector 128 and performing tasks relating to data acquisition and signal analysis as necessary to generate chromatograms, drift spectra, and mass (m/z ratio) spectra characterizing the sample under analysis. The computing device 118 may also be configured for providing and controlling a user interface that provides screen displays of spectrometric data and other data with which a user may interact. The computing device 118 may include one or more reading devices on or in which a tangible computer-readable (machine-readable) medium may be loaded that includes instructions for performing all or part of any of the methods disclosed herein. For all such purposes, the computing device 118 may be in signal communication with various components of the spectrometry system 100 via wired or wireless communication links (as partially represented, for example, by dashed lines between the computing device 118 and the MS 116, and between the computing device 118 and the ion gate 106A or 106B). Also for these purposes, the computing device 118 may include one or more types of hardware, firmware and/or software, as well as one or more memories and databases.

The computing device 118 may include one or more modules (or units, or components) configured for performing specific data acquisition or signal processing functions. In some embodiments, these modules may include a pulse sequence generator 186 and a deconvolution (or demultiplexing) module 190. These modules are described further below.

Figure 1B:
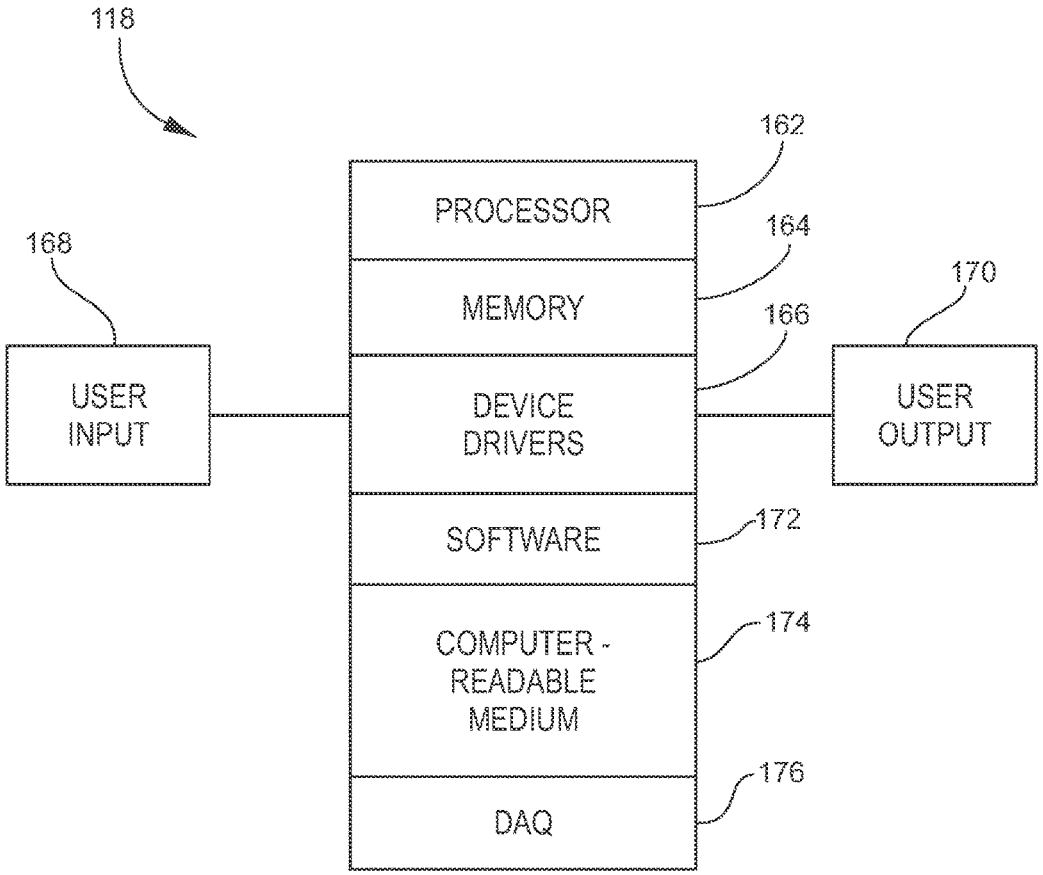
FIG. 1B is a schematic view of an example of a computing device that may be part of or communicate with the spectrometry system illustrated in FIG. 1A, according to some embodiments.

FIG. 1B is a schematic view of a non-limiting example of a computing device 118 that may be part of or communicate with a spectrometry system such as the spectrometry system 100 illustrated in FIG. 1A. In the illustrated embodiment the computing device 118 includes a processor 162 (typically electronics-based), which may be representative of a main electronic processor providing overall control, and one or more electronic processors configured for dedicated control operations or specific signal processing tasks (e.g., a graphics processing unit, or GPU). The computing device 118 also includes one or more memories 164 (volatile and/or non-volatile) for storing data and/or software. The computing device 118 may also include one or more device drivers 166 for controlling one or more types of user interface devices and providing an interface between the user interface devices and components of the computing device 118 communicating with the user interface devices. Such user interface devices may include user input devices 168 (e.g., keyboard, keypad, touch screen, mouse, joystick, trackball, and the like) and user output devices 170 (e.g., display screen, printer, visual indicators or alerts, audible indicators or alerts, and the like). In various embodiments, the computing device 118 may be considered as including one or more user input devices 168 and/or user output devices 170, or at least as communicating with them. The computing device 118 may also include one or more types of computer programs or software 172 contained in memory and/or on one or more types of computer-readable media 174. Computer programs or software may contain instructions (e.g., logic instructions) for performing all or part of any of the methods disclosed herein. Computer programs or software may include application software and system software. System software may include an operating system (e.g., a Microsoft Windows® operating system) for controlling and managing various functions of the computing device 118, including interaction between hardware and application software. In particular, the operating system may provide a graphical user interface (GUI) displayable via a user output device 170 such as a display screen, and with which a user may interact with the use of a user input device 168 such as a keyboard or a pointing device (e.g., mouse). The computing device 118 may also include one or more data acquisition/signal conditioning components 176 (as may be embodied in hardware, firmware and/or software) for receiving and processing ion measurement signals outputted by the ion detector 150, including formatting data for presentation in graphical form by the GUI. The data acquisition/signal conditioning components 176 may include signal processing modules such as the PRS generator 186, the pre-deconvolution module 188, the deconvolution module 190, and the post-deconvolution module 192 noted above and described in further detail below.

It will be understood that FIGS. 1A and 1B are high-level schematic depictions of an example of a spectrometry system 100 and associated computing device 118 consistent with the present disclosure. Other components, such as additional structures, vacuum pumps, gas plumbing, ion optics, ion guides, electronics, and computer- or electronic processor-related components may be included as needed for practical implementations. It will also be understood that the computing device 118 is schematically represented in FIGS. 1A and 1B as functional blocks intended to represent structures (e.g., circuitries, mechanisms, hardware, firmware, software, etc.) that may be provided. The various functional blocks and signal links have been arbitrarily located for purposes of illustration only and are not limiting in any manner. Persons skilled in the art will appreciate that, in practice, the functions of the computing device 118 may be implemented in a variety of ways and not necessarily in the exact manner illustrated in FIGS. 1A and 1B and described herein.

An example of the general operation of the spectrometry system 100 for acquiring spectral data from a sample will now be described. The ion source 104 ionizes a sample, forming analyte ions, and transmits the ions into the ion trap 134 (if provided). The ion trap 134 accumulates the ions for a period of time (e.g., 1 ms). The ion gate 106 periodically opens momentarily (e.g., 150 μs) to inject discrete ion packets sequentially into the IM drift cell 142. Each ion packet may contain ions having a range of m/z ratios. The injection sequencing of the ion gate 106 is controlled by the computing device 118. The intervals of time between injections (when the ion gate 106 is closed) is typically on the scale of milliseconds (ms). The ion packets drift through the IM drift cell 142 under the influence of the electric field gradient (which is typically uniform and relatively weak) established by the drift cell electrodes 146. As the ion packets drift through the IM drift cell 142, collisions occur between the ions and the drift gas. Consequently, the ion packets become spread out in time and space in accordance with the mobility distribution of the ions. The ions exit the IM drift cell 142 and are transmitted into the MS 116. As described above, in some embodiments the ions may be subjected to intermediate processes in an ion processing section 112 before entering the MS 116, such as focusing, cooling, mass filtering or selection, fragmentation, etc.

As the ions enter the MS 116 (assuming a TOF-based MS), the ion pulser of the MS 116 injects (pulses) the ions into the flight tube according to a sequence controlled by the computing device 118. Hence, the MS 116 injects "new" ion packets into the flight tube. The ion packets injected into the flight tube are "new" in the sense that they are not the same packets as those originally injected into the IM drift cell 142. The TOF injection pulses typically occur on a much faster time scale (e.g., μs) than the IM injection pulses (e.g., ms). That is, the TOF injection rate (or frequency) is typically much higher than the IM injection rate (or frequency), such that many TOF injection pulses occur during the period between two sequential IM injection pulses. As the ion packets drift through the electric field-free region of the flight tube, the ion packets become spread out in time and space in accordance with the TOF distribution of the ions. The ion detector 150 located at the end of the flight path counts each ion impacting the ion detector 150 and measures its arrival time, and the detector output signal is digitized and recorded in a manner appreciated by persons skilled in the art. The arrival time of an ion at the ion detector 150 is a sum of the ion's drift time through the IM drift cell 142, flight time through the flight tube (TOF), and travel time through other regions of the system between the IM drift cell 142 and the flight tube. The data acquisition/signal components (schematically associated with the computing device 118 in FIGS. 1A and 1B) are configured for calculating the drift time and TOF of each ion from the measured arrival time, as well as determining m/z ratio based on TOF as noted earlier. The data acquisition/signal components are also configured for producing drift time and mass spectra from the raw measurement data (arrival times and ion counts) measured by the ion detector 150.

In the above-described operation, injection of ion packets into the IM drift cell 142 may be multiplexed such that two or more adjacent ion packets become overlapped in the IM drift cell 142 at some point in time during their travel through the IM drift cell 142. Likewise, injection of ion packets into the flight tube of the mass analyzer 148 may be multiplexed such that two or more adjacent ion packets become overlapped in the flight tube at some point in time during their travel through the flight tube. The computing device 118 (or a modulating device controlling the ion gate 106 and controlled by the computing device 118) may be configured for implementing multiplexed injection into the IM drift cell 142 by controlling the opening and closing of the ion gate 106 according to a pulse sequence of binary 1's and 0's. In typical yet non-limiting embodiments, the pulse sequence is a pseudorandom sequence (PRS), also known as a pseudorandom binary sequence. One of the binary states (e.g., binary 1), which may also be referred to as an ON state (or pulse) or open state, corresponds to opening the ion gate 106 for a brief period of time (e.g., 150 μs) followed by closing the ion gate 106. The ON pulse results in an ion packet being injected into the IM drift cell 142. The other binary state (e.g., binary 0), which may also be referred to as an OFF state (or pulse) or closed state, corresponds to closing the ion gate 106 for a period of time lasting until the next ON pulse. The present disclosure arbitrarily associates the ON state with binary 1 and the OFF state with binary 0.

The pulse sequence generator 186 may generate the PRS, for example, through the operation of linear feedback shift registers. In some embodiments, the PRS is a maximum length sequence (MLS). An MLS-type PRS has a length $N=2^m-1$, where m is the number of bits (or shift registers) utilized to construct the PRS. As examples, a 3-bit PRS has a length N=7 ($2^4-1$), a 4-bit PRS has a length N=15 ($2^4-1$), and a 5-bit PRS has a length N=31 ($2^5-1$). Examples of 3-bit, 4-bit, and 5-bit PRSs are as follows:

3 bits: {0, 0, 1, 0, 1, 1, 1}

4 bits: {0, 0, 0, 1, 0, 0, 1, 1, 0, 1, 0, 1, 1, 1, 1}

5 bits: {0, 0, 0, 0, 1, 0, 0, 1, 0, 1, 1, 0, 0, 1, 1, 1, 1, 1, 0, 0, 0, 1, 1, 0, 1, 1, 1, 0, 1, 0, 1}

Figure 2:
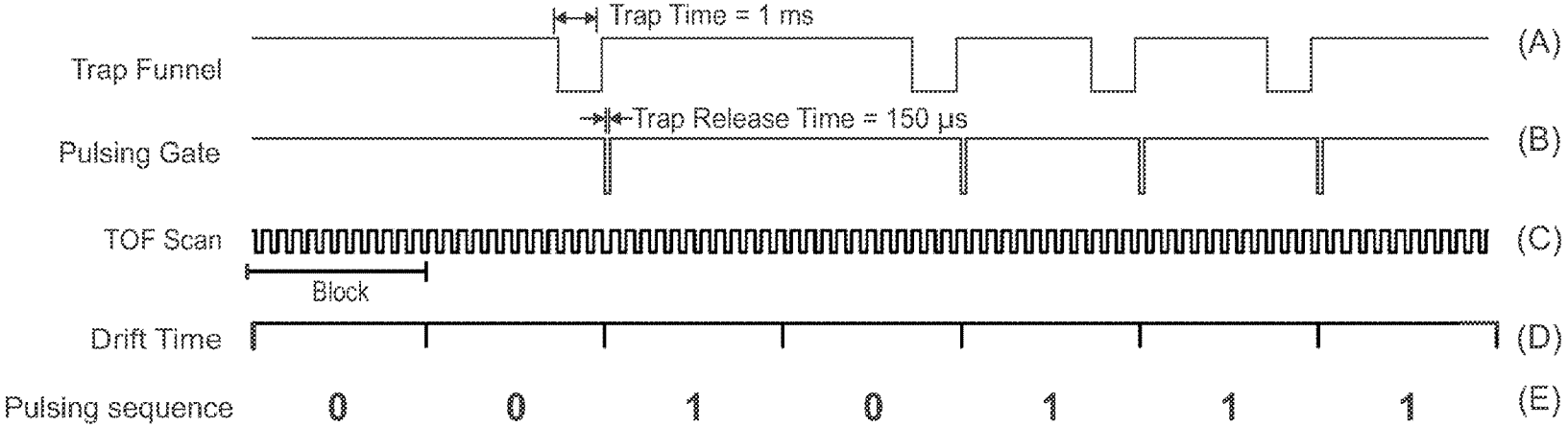
FIG. 2 illustrates an example of a set of timing sequences for operation of an ion trap (sequence A), an ion gate (sequence B), and a TOF pulser (sequence C), and also illustrates a corresponding drift time period (sequence D) and a pseudo-random sequence (PRS) applied to the ion gate (sequence E), according to some embodiments.

FIG. 2 illustrates a set of timing sequences for operation of the ion trap 134 (sequence A), ion gate 106A (sequence B), and TOF pulser (sequence C). FIG. 2 also illustrates the corresponding drift time period (sequence D) and the PRS applied to the ion gate 106A (sequence E). The PRS selected for the example in FIG. 2 is the 3-bit PRS set forth above. The total period of time over which the sequence occurs (corresponding to the overall drift time period shown in FIG. 2) may constitute a single experiment, or a single iteration that may be repeated one or more times (e.g., thousands of times) during a given experiment, as appreciated by persons skilled in the art. In the present embodiment, the (overall) drift time period is divided into drift time blocks (segments, bins, etc.) of equal duration, as indicated by sequence D. The number of drift time blocks is equal to the length N (the number of binary elements) of the PRS, which in this example is seven. Each binary element of the PRS is exclusively associated with one of the drift time blocks. Likewise, each ion trapping event and each ion gate-open (trap release, or injection) event are exclusively associated with one of the drift time blocks. Each ion trapping event is immediately followed by a gate-open event. Each ion trapping event may be of equal duration (e.g., 1 ms), and the duration is shorter than the duration of the drift time blocks (e.g., several ms each). Each gate-open event may be of equal duration (e.g., 150 μs), and the duration is likewise shorter than the duration of the drift time blocks. Each TOF injection pulse may be of equal duration (e.g., on the order of μs), and the duration is shorter than the duration of the drift time blocks. By example only, FIG. 2 shows twelve TOF injection pulses per drift time block, with the understanding that more or less TOF injection pulses may occur during each drift time block.

In the present example, the PRS begins with two successive binary 0 states. Accordingly the ion gate 106 is closed, and thus no ion packets are injected into the IM drift cell 142, during the first two drift time blocks. The first two binary 0 states are followed by a binary 1 state. Accordingly, ion trapping is initiated at or near the end of the second drift time block to accumulate ions, and the ion trapping (accumulation) period is followed by opening the ion gate 106 at the start of the third drift time block to inject an ion packet into the IM drift cell 142. As noted above, the ion gate 106 is open only for a brief period of time and thus is closed for the remaining duration of the third drift time block. The fourth drift time block is associated with binary 0, and accordingly the ion gate 106 remains closed during the entire fourth drift time block. The fifth, sixth, and seventh drift time blocks are each associated with binary 1's, and thus ion injecting events occur in each of the fifth, sixth, and seventh drift time blocks (respectively preceded by ion trapping events at the end of the fourth, fifth, and sixth drift time blocks).

Each period of time during which the ion gate 106 is open may be considered as an ON pulse. All remaining periods of time (the intervals between ON pulses) may be considered as OFF pulses. From FIG. 2, it is seen that each drift time block includes either a single ON pulse followed by an OFF pulse (when the drift time block is associated with binary 1), or no ON pulses (when the drift time block is associated with binary 0). Also, the durations of the OFF pulses included in the injection sequence are variable. This is because the duration of an OFF pulse depends on whether a binary 1 is followed by another binary 1 or by a binary 0, or by two or more successive binary 0's. Moreover, the duration of an OFF pulse may be longer than the duration of a single drift time block. For example, in FIG. 2, the third, fourth, and fifth drift time blocks are associated with the sub-sequence {1, 0, 1}. Hence, an OFF pulse extends over a portion of the third drift time block and over the entire duration of the fourth drift time block, and ends at the beginning of the fifth drift time block at which time the next ON pulse occurs. It is also seen that for a given IM device 108, the drift time blocks may be scaled as needed for the PRS applied to ion gate 106A to effect multiplexed injection, with some degree of overlapping occurring between one or more pairs of adjacent ion packets as they travel through the drift cell 142.

Due to the overlapping, at any given instant of time during the experiment, ions of differing mobility and/or m/z ratios may arrive at the ion detector 150 simultaneously. Hence, the resulting raw measurement data generated by the ion detector 150 is a measurement of several pulsing events (drift time distributions and/or TOF distributions), each of which is shifted in time relative to the start time of the PRS, and some of which overlap with preceding and/or succeeding pulsing events. In mathematical terms, this raw measurement data may be considered as being a convolution of a single pulsing event and the PRS (or other type of pulse sequence that was employed). The deconvolution (or demultiplexing) module 190 may be configured for recovering a single spectrum (a set of spectral data corresponding to a single pulsing event) by subjecting the convoluted raw measurement data to a deconvolution (or demultiplexing) process that utilizes knowledge of the particular PRS (or other pulse sequence) that was applied to the ion gate 106. The deconvolution process may entail the application of an appropriately designed deconvolution algorithm.

In some embodiments, the convolution may be expressed as A=p [S], where A is the measured intensity array (raw measurement data); p is a single pulsing event sought to be recovered, in the form of a vector of length N (an N-element vector); and [S] is a function (e.g., a transfer function, or transform) in square (N×N) matrix form related to the applied PRS (or other pulse sequence). In some embodiments, the deconvolution module 190 (FIG. 1A) is configured for constructing the matrix [S] from the PRS (or other pulse sequence), calculating the inverse of the matrix [S], i.e., the inverse matrix $[S]^{-1}$, and multiplying both sides of the expression A=p [S] by the matrix $[S]^{-1}$ as follows: $[S]^{-1}$ A=p [S] $[S]^{-1}$. This process yields the demultiplexed single pulsing event p=A $[S]^{-1}$, which may then be processed to construct drift time spectra and/or mass spectra, as appreciated by persons skilled in the art. The matrix [S] may be a Hadamard transform (HT) or fast Hadamard transform, or alternatively may be another type of transform utilized in signal processing and that is based on a PRS or other code utilized for multiplexing. An example of the matrix [S] for the 3-bit PRS set forth above and the inverse matrix $[S]^{-1}$ is the following:

$$[S] = \begin{bmatrix} 0 & 0 & 1 & 0 & 1 & 1 & 1 \\ 1 & 0 & 0 & 1 & 0 & 1 & 1 \\ 1 & 1 & 0 & 0 & 1 & 0 & 1 \\ 1 & 1 & 1 & 0 & 0 & 1 & 0 \\ 0 & 1 & 1 & 1 & 0 & 0 & 1 \\ 1 & 0 & 1 & 1 & 1 & 0 & 0 \\ 0 & 1 & 0 & 1 & 1 & 1 & 0 \end{bmatrix}$$

$$[S]^{-1} = \begin{bmatrix} -0.25 & 0.25 & 0.25 & 0.25 & -0.25 & 0.25 & -0.25 \\ -0.25 & -0.25 & 0.25 & 0.25 & 0.25 & -0.25 & 0.25 \\ 0.25 & -0.25 & -0.25 & 0.25 & 0.25 & 0.25 & -0.25 \\ -0.25 & 0.25 & -0.25 & -0.25 & 0.25 & 0.25 & 0.25 \\ 0.25 & -0.25 & 0.25 & -0.25 & -0.25 & 0.25 & 0.25 \\ 0.25 & 0.25 & -0.25 & 0.25 & -0.25 & -0.25 & 0.25 \\ 0.25 & 0.25 & 0.25 & -0.25 & 0.25 & -0.25 & -0.25 \end{bmatrix}$$

The matrix [S] is constructed from the PRS (or other pulse sequence), and the inverse matrix $[S]^{-1}$ is calculated from the matrix [S], according to known principles. The matrix [S] utilized in the present example, containing only 1's and 0's, is useful in embodiments where a single ion detector is employed, and the ion detector receives ions launched during the ON states of the ion gate (1's) while ions deflected during the OFF states are not detected by the ion detector.

After deconvolution, the resulting deconvoluted measurement data are utilized to produce a drift time versus abundance spectrum, a mass versus abundance spectrum, or a drift time versus mass versus abundance spectrum, depending on whether the spectrometry system 100 is an IMS system, a MS system, or an IM-MS system, respectively.

Figure 3A:
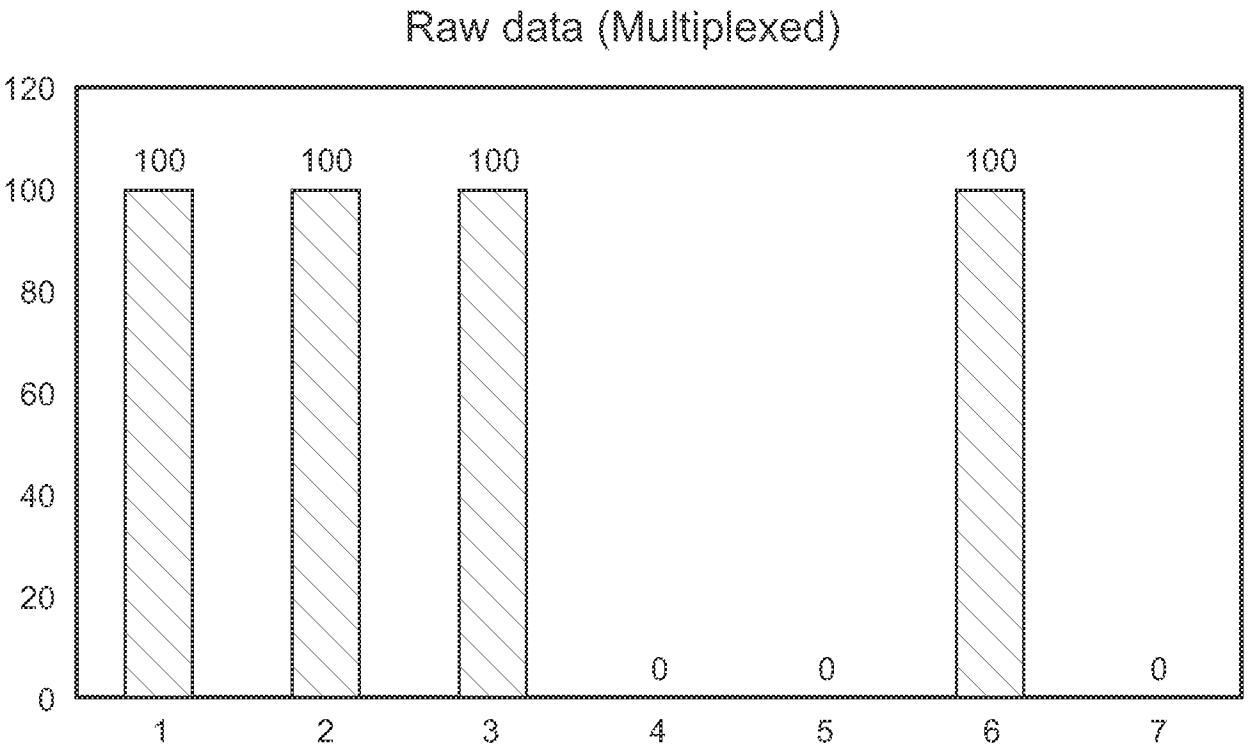
FIG. 3A illustrates one row (linear array) of a simplified example of a 2D array of raw measurement data acquired utilizing a 3-bit PRS.
Figure 3B:
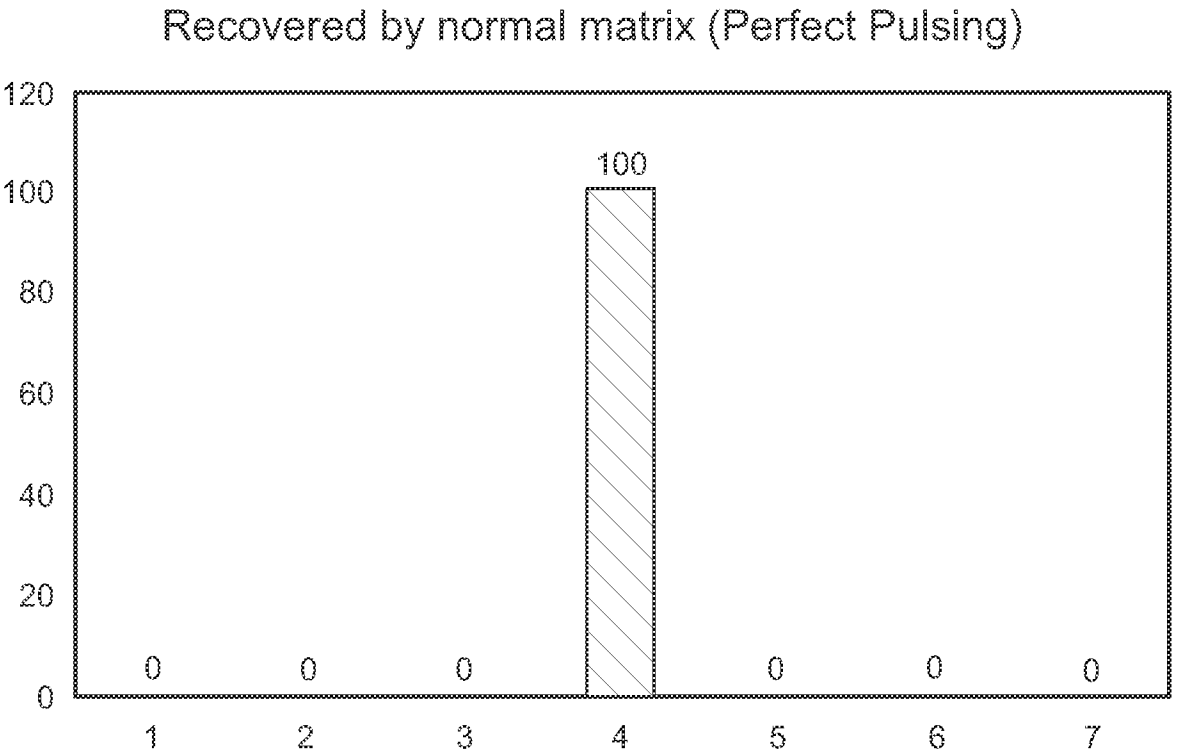
FIG. 3B illustrates a recovered signal after utilizing a conventional matrix to deconvolute the raw measurement data shown in FIG. 3A.

FIGS. 3A and 3B illustrate an example of the application of deconvolution in the ideal case of perfect pulsing, i.e., a case in which the acquired measurement data contain no noise. Specifically, FIG. 3A illustrates one row (linear array) of a simplified example of a 2D array of raw measurement data acquired utilizing a 3-bit PRS. The data points (abundance peaks) are signal intensity values corresponding to abundance (ion counts). In this example, the row includes four positive-value data points, which for simplification each have a signal intensity value of 100. Thus, the raw data array is A=[100, 100, 100, 0, 0, 100, 0]. FIG. 3B illustrates the recovered signal p, corresponding to a single pulsing event, after utilizing the conventional matrix to deconvolute the raw measurement data shown in FIG. 3A.

Figure 4A:
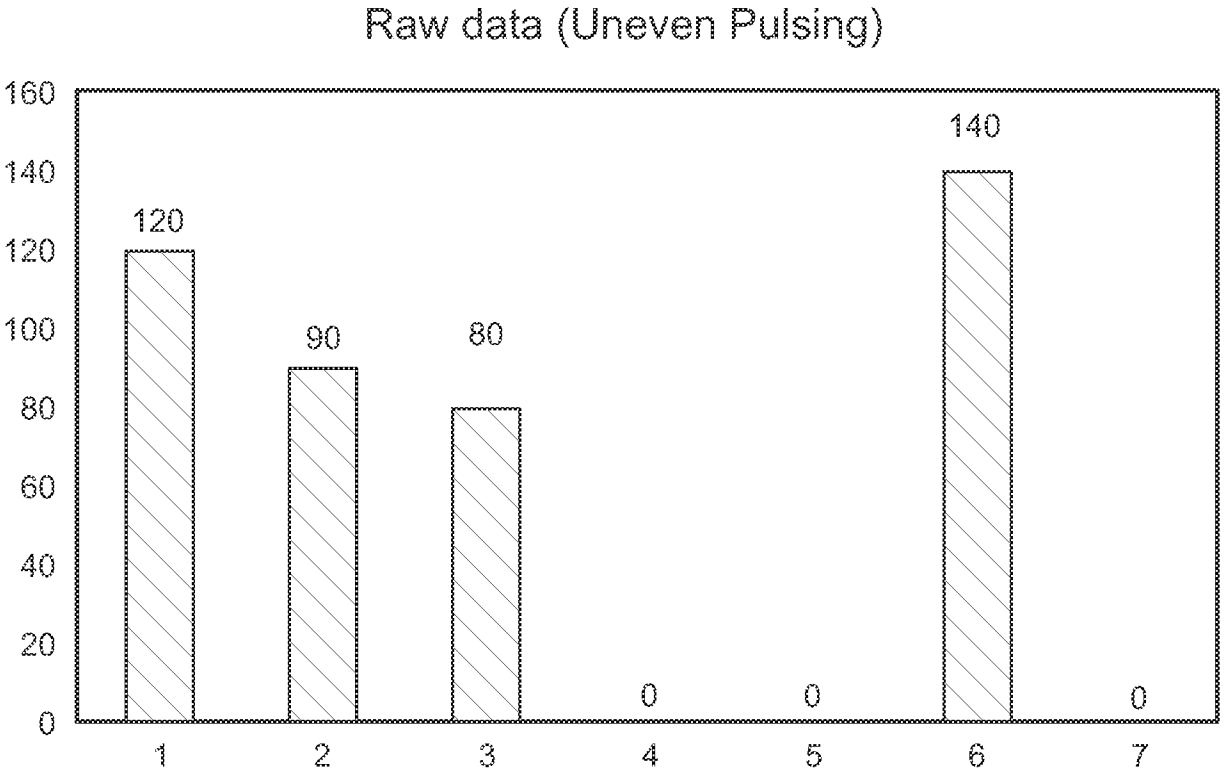
FIG. 4A illustrates one row (linear array) of another simplified example of a 2D array of raw measurement data acquired utilizing a 3-bit PRS.
Figure 4B:
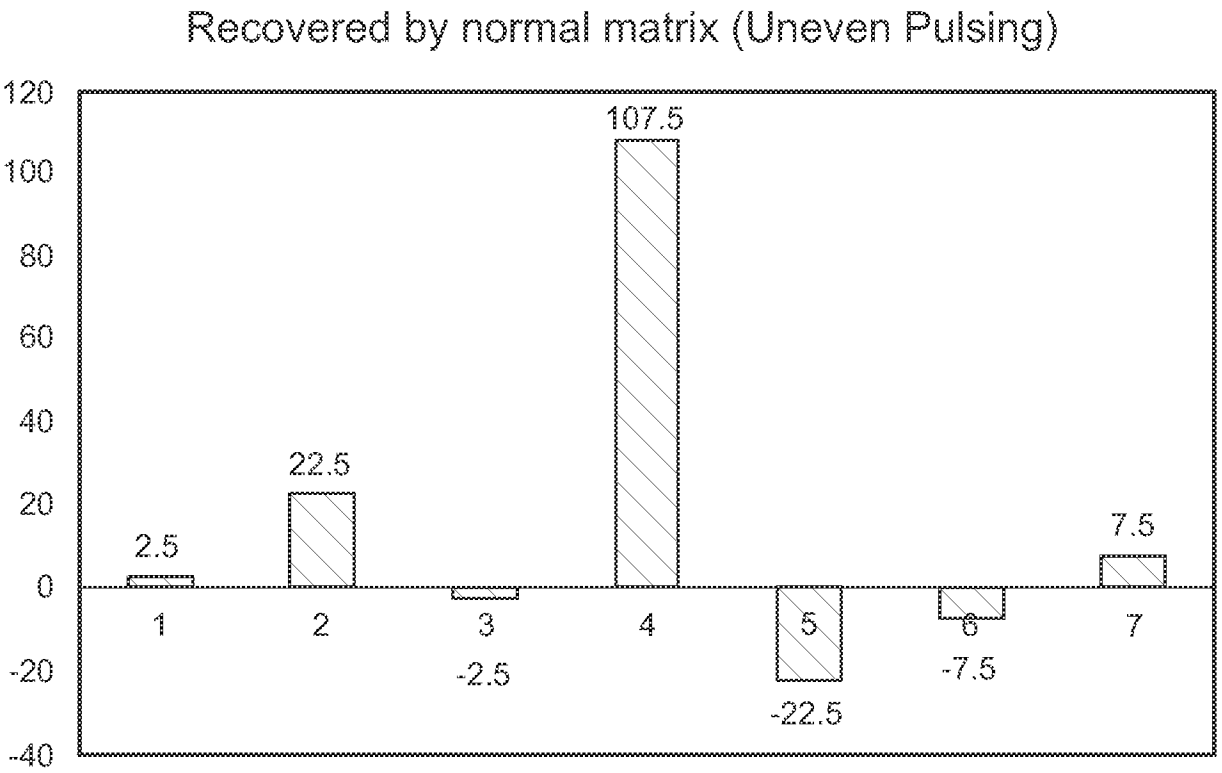
FIG. 4B illustrates a recovered signal after utilizing a conventional matrix to deconvolute the raw measurement data shown in FIG. 4A.

As noted earlier, the raw measurement data may include noise components (i.e., imperfect pulsing or uneven pulsing) that cause errors or inaccuracies in the deconvoluted measurement data, in turn leading to errors or inaccuracies in the drift time and/or mass spectra constructed from the deconvoluted measurement data. FIGS. 4A and 4B illustrate an example of the application of deconvolution in such a non-ideal case, which may be compared to the ideal case shown in FIGS. 3A and 3B. Specifically, FIG. 4A illustrates one row (linear array) of a simplified example of a 2D array of raw measurement data acquired utilizing a 3-bit PRS. The row includes four positive-value data points having signal intensity values of 120, 90, 80, and 140, respectively. Thus, the raw data array in this case is A=[120, 90, 80, 0, 0, 140, 0]. FIG. 4B illustrates the recovered signal after utilizing the conventional matrix to deconvolute the raw measurement data shown in FIG. 4A. In this case, the recovered signal is an array, [2.5, 22.5, −2.5, 107.5, −22.5, 7.5, 7.5], which indicates that the recovered data include noise components as a result of the uneven pulsing.

According to some embodiments, a method is implemented for deconvoluting (or demultiplexing, or demodulating) raw measurement data based on a modified (i.e., new) pulse sequence. A standard pulse sequence (e.g., PRS) is utilized to control the ion gate and consequently acquire the raw measurement data. The pulse sequence generator 186 (FIG. 1A) may be utilized to generate the standard pulse sequence. Then, based on the raw measurement data so acquired, the method automatically determines a modified pulse sequence. The method then constructs the matrix [S] and the inverse matrix $[S]^{-1}$ based on the modified pulse sequence. This modified (or new) inverse function $[S]^{-1}$ is then utilized to recover a single pulsing event p in which noise components have been eliminated. The deconvoluted measurement data associated with the recovered single pulsing event p may then be utilized to produce drift time and/or mass spectra as described above. The deconvolution module 190 (FIG. 1A) may be configured for implementing this method.

Figure 5:
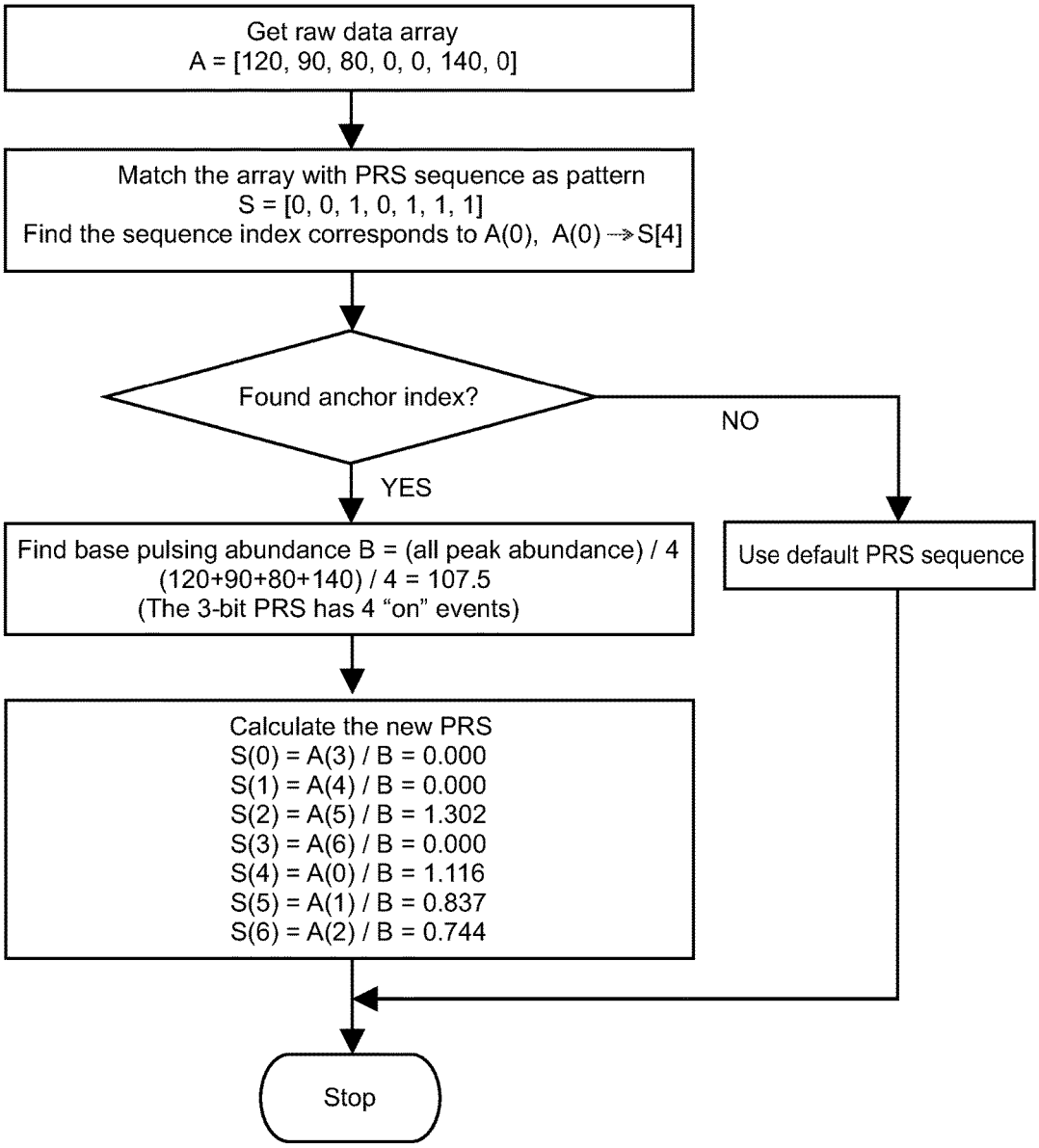
FIG. 5 is a flow diagram of a method for determining a modified pulse sequence for use in constructing a demultiplexing matrix, which may be implemented as part of a method for deconvoluting raw measurement data, according to some embodiments.

A non-limiting example of a method for deconvoluting raw measurement data will now be described using the example of FIGS. 4A and 4B and making further reference to FIGS. 5 to 7. FIG. 5 is a flow diagram 500 of a method for determining a modified pulse sequence for use in constructing a demultiplexing matrix, which may be implemented as part of a method for deconvoluting raw measurement data. The flow diagram may also be representative of a system, deconvolution module 190 (FIG. 1A), and/or computer program product configured for implementing the method.

According to the method, an array of raw measurement data A is acquired (step 502). In the present example, the raw data array is A=[120, 90, 80, 0, 0, 140, 0] as described above and shown in FIG. 4A. The array is then matched (aligned) with the pattern of the pulse sequence, which includes finding the sequence index of the pulse sequence that corresponds to the first data point in the raw data array A (step 504). In the present example, the first data point in the raw data array A is labeled A(0), i.e., zero (0) is used as the starting (first) index value. Thus in the present example, A(0)=120. Also, in the present example, the 3-bit PRS noted above and shown in FIG. 2 was utilized for the pulse sequence and may be expressed as S=[0, 0, 1, 0, 1, 1, 1]. Hence the raw data array A and the 3-bit PRS, before being aligned, are positioned or indexed as follows:

| | |
|---|---|
| A(0) = 120 | S(0) = 0 |
| A(1) = 90 | S(1) = 0 |
| A(2) = 80 | S(2) = 1 |
| A(3) = 0 | S(3) = 0 |
| A(4) = 0 | S(4) = 1 |

-continued

| | |
|---|---|
| A(5) = 140 | S(5) = 1 |
| A(6) = 0 | S(6) = 1 |

In this example, the sequence index corresponding to A(0) is S(4), or A(0)→S(4). FIG. 6 illustrates the same raw data array A as shown in FIG. 4A, but also presents the pulse sequence S below the horizontal axis. FIG. 6 illustrates the indicial or positional relation between the data points of the raw data array A and the pulse values of the pulse sequence S before alignment. It will be noted that the numbers on the horizontal axis identifying the sequence of data bins—1, 1, 2, 3, 4, 5, 6, and 7—correspond to the index values 0, 1, 2, 3, 4, 5, and 6, respectively. FIG. 6 shows how the raw data array A may be aligned with the pulse sequence S, i.e., how the data positions (indices) of the raw data array A may be associated with the corresponding sequence indices of the pulse sequence S so as to match their respective patterns. Specifically, the arrows in FIG. 6 show which data points of the raw data array A correspond to which indices of the pulse sequence S as needed to correctly align the pattern of the raw data array A with the pattern of the pulse sequence S. It is seen that the starting index of the raw data array, A(0)=120, corresponds to pulse sequence index S(4), as indicated by the arrow leading from A(0) (bin 1) to S(4). The sequence index corresponding to A(0), S(4) in the present example, may be referred to as the anchor index. It can be seen that the pattern of the raw data array A shown in FIG. 6 (i.e., the sequence of three positive values, followed by two zeros, followed by a single positive value, followed by a single zero) can be matched to the pulse sequence S=[0, 0, 1, 0, 1, 1, 1] by shifting and wrapping around the raw data points by four index positions. In this manner, the pattern of the raw data array A becomes aligned with the pulse sequence S, with each positive raw data value associated with a binary 1 and each zero raw data value associated with a binary 0 in the correct order or sequence.

Thus, the raw data array A and the pulse sequence S may be matched or aligned as follows:

| | |
|---|---|
| S(0) = 0 | A(3) = 0 |
| S(1) = 0 | A(4) = 0 |
| S(2) = 1 | A(5) = 140 |
| S(3) = 0 | A(6) = 0 |
| S(4) = 1 | A(0) = 120 |
| S(5) = 1 | A(1) = 90 |
| S(6) = 1 | A(2) = 80 |

It will be noted that the initial mismatch or misalignment (or "wrap-around") between the raw data array A and the pulse sequence S is caused by the delay between the operation of the ion gate according to the pulse sequence and the actual counting of the ions at the downstream ion detector.

Continuing with the method, a determination is then made as to whether an anchor index has been found (step 506)—in other words, whether a pattern of the raw data array A has been found that could be matched with the pattern of the pulse sequence S. If, for example, the signal is low such that the noise is too high, an anchor index may not be found. If an anchor index has not been found, then the default pulse sequence (in the present example, S=[0, 0, 1, 0, 1, 1, 1]) is utilized (step 508) to construct the matrix [S] and consequently the inverse matrix $[S]^{-1}$ for the purpose of deconvoluting the raw data of array A.

If, on the other hand, an anchor index was found as in the case of the present example, the method proceeds to determining a modified pulse sequence for use in the deconvolution. First, a base pulsing abundance B is found (step 510) by summing all of the positive-value data points in the raw data array A, and dividing the sum by the number of positive-value data points P in the raw data array A, as follows: B=(all peak abundances)/P. In the present example, the raw data array A contains four positive-value data points (P=4): 120, 90, 80, and 140. Thus, the base pulsing abundance B=(120+90+80+140)/4=107.5. Then, the modified pulse sequence S is calculated (step 512) by dividing the value of each data point in the raw data array A (whether positive-value or zero) by the base pulsing abundance B, and assigning these modified values to the respective indices of the pulse sequence S in accordance with the matched (aligned) relation found in step 504. Using the present example, calculation of the modified pulse sequence S is set forth below:

S(0)=A(3)/B=0.000
S(1)=A(4)/B=0.000
S(2)=A(5)/B=1.302
S(3)=A(6)/B=0.000
S(4)=A(0)/B=1.116
S(5)=A(1)/B=0.837
S(6)=A(2)/B=0.744

Thus, the modified pulse sequence is S=[0.000, 0.000, 1.302, 0.000, 1.116, 0.837, 0.744]. The method for determining a modified pulse sequence for use in constructing a demultiplexing matrix then ends at step 514.

The modified pulse sequence may then be utilized in constructing the matrix [S] and consequently the inverse matrix (demultiplexing matrix) $[S]^{-1}$, examples of which, in the context of the present example, are set forth below:

$$[S] = \begin{bmatrix} 0.000 & 0.000 & 1.302 & 0.000 & 1.116 & 0.837 & 0.744 \\ 0.744 & 0.000 & 0.000 & 1.302 & 0.000 & 1.116 & 0.837 \\ 0.837 & 0.744 & 0.000 & 0.000 & 1.302 & 0.000 & 1.116 \\ 1.116 & 0.837 & 0.744 & 0.000 & 0.000 & 1.302 & 0.000 \\ 0.000 & 1.116 & 0.837 & 0.744 & 0.000 & 0.000 & 1.302 \\ 1.302 & 0.000 & 1.116 & 0.837 & 0.744 & 0.000 & 0.000 \\ 0.000 & 1.302 & 0.000 & 1.116 & 0.837 & 0.744 & 0.000 \end{bmatrix}$$

$$[S]^{-1} = \begin{bmatrix} -0.339 & 0.091 & 0.286 & 0.282 & -0.110 & 0.290 & -0.250 \\ -0.250 & -0.339 & 0.091 & 0.286 & 0.282 & -0.110 & 0.290 \\ 0.290 & -0.250 & -0.339 & 0.091 & 0.286 & 0.282 & -0.110 \\ -0.110 & 0.290 & -0.250 & -0.339 & 0.091 & 0.286 & 0.282 \\ 0.282 & -0.110 & 0.290 & -0.250 & -0.339 & 0.091 & 0.286 \\ 0.286 & 0.282 & -0.110 & 0.290 & -0.250 & -0.339 & 0.091 \\ 0.091 & 0.286 & 0.282 & -0.110 & 0.290 & -0.250 & -0.339 \end{bmatrix}$$

Again, the matrix [S] is constructed from the modified pulse sequence, and the inverse matrix $[S]^{-1}$ is calculated from the matrix [S], according to known principles.

Figure 7:
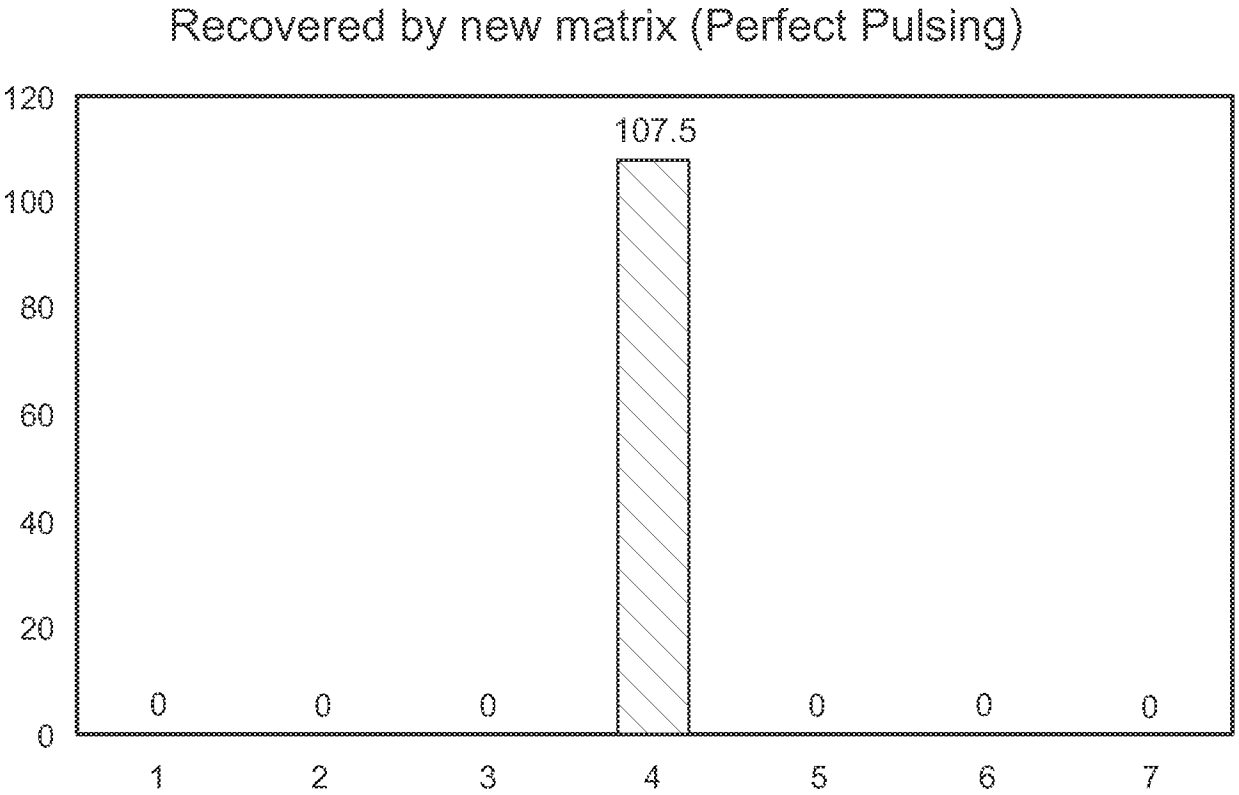
FIG. 7 illustrates a recovered signal after utilizing the demultiplexing matrix based on the modified pulse sequence as disclosed herein to deconvolute the raw measurement data shown in FIG. 4A.

FIG. 7 illustrates the recovered signal after utilizing the demultiplexing matrix based on the modified pulse sequence calculated above to deconvolute the raw measurement data shown in FIG. 4A. It is seen in FIG. 7 that the noise components have been eliminated, as compared to FIG. 4B.

Thus, in some embodiments a method for determining a demultiplexing matrix for use in deconvoluting ion measurement data may proceed as follows. Ion measurement data are acquired that include positive-value data points and non-positive-value data points. The ion measurement data are arranged ion measurement data into a raw data array that is a pattern of the positive-value data points and the non-positive-value data points. The pattern of the raw data array matches the pattern of ON pulses and OFF pulses of the initial pulse sequence (e.g., a PRS), such that the positive-value data points correspond to respective ON pulses and the non-positive-value data points correspond to respective OFF pulses. That is, every binary 1 in the initial pulse sequence corresponds to a positive-value data point in the raw data array, and every binary 0 in the initial pulse sequence corresponds to a non-positive-value data point in the raw data array. Furthermore, the order or pattern in which the binary 1's and 0's appear in the initial pulse sequence matches the order or pattern in which the positive-value data points and non-positive-value data points appear in the raw data array. For example, the subset of the binary 0 followed by three consecutive binary 1's in the initial pulse sequence corresponds to the subset of the zero data point followed by the three consecutive positive-value data points 120, 90, and 80 in the raw data array. A modified pulse sequence is then constructed by replacing each ON pulse of the initial pulse sequence with a corresponding modified ON pulse. Each modified ON pulse has a value proportional to the value of the corresponding positive-value data point. Moreover, the modified pulse sequence comprises a pattern of modified ON pulses and OFF pulses that matches the pattern of ON pulses and OFF pulses of the initial pulse sequence. A demultiplexing matrix is then constructed based on the modified pulse sequence. In the above example, the demultiplexing matrix is constructed by first using the modified pulse sequence to construct the square (N×N) matrix [S], and then finding inverse matrix $[S]^{-1}$ according to an appropriate mathematical technique known to persons skilled in the art. The inverse matrix $[S]^{-1}$ may then serve as the demultiplexing matrix applied to the raw data array to deconvolute the data.

In some embodiments, as in the above example, obtaining the modified ON pulses is done by carrying out the following steps: determining the number P of positive-value data points in the raw data array; determining a data point sum by summing the values of the positive-value data points; determining a base abundance B by dividing the data point sum by the number of positive-value data points; and dividing the respective values of the positive-value data points by the base abundance. The resulting values after dividing are the utilized as the respective values of the modified ON pulses, and thus comprise the elements of the modified pulse sequence.

In some embodiments, as in the above example, before arranging the ion measurement data a determination is made as to whether the pattern of the positive-value data points and non-positive-value data points of the ion measurement data can actually be matched with the pattern of ON pulses and OFF pulses of the initial pulse sequence. If a match in the two patterns is found, then the modified pulse sequence is calculated and the demultiplexing matrix is constructed based on the modified pulse sequence as described above. If, on the other hand, it is determined that the pattern of the positive-value data points and non-positive-value data points cannot be matched with the pattern of ON pulses and OFF pulses of the initial pulse sequence, then the demultiplexing matrix is constructed based on the initial pulse sequence instead of the modified pulse sequence.

Figure 8A:
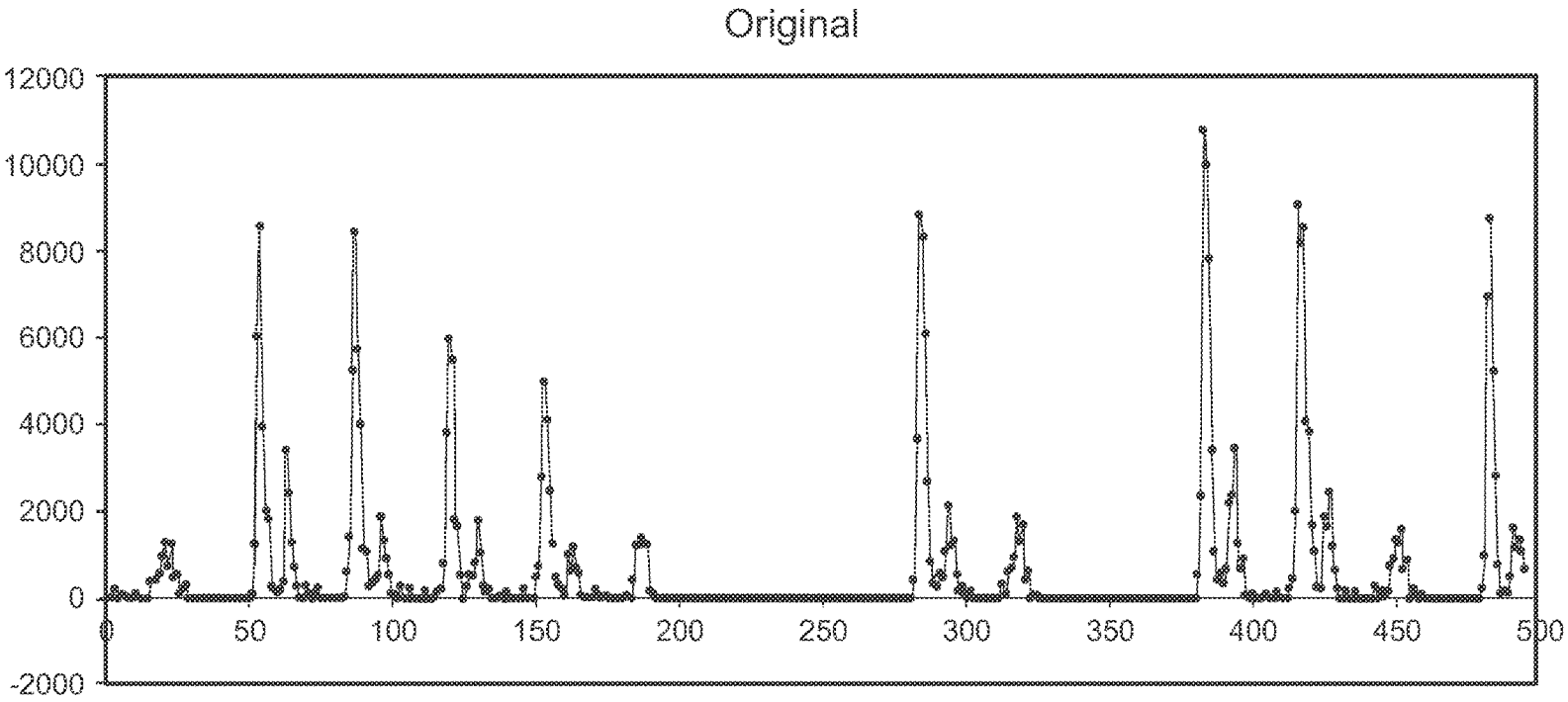
FIG. 8A is an example of a drift spectrum (ion signal intensity as a function of drift time in milliseconds) without (or before) performing deconvolution.
Figure 8B:
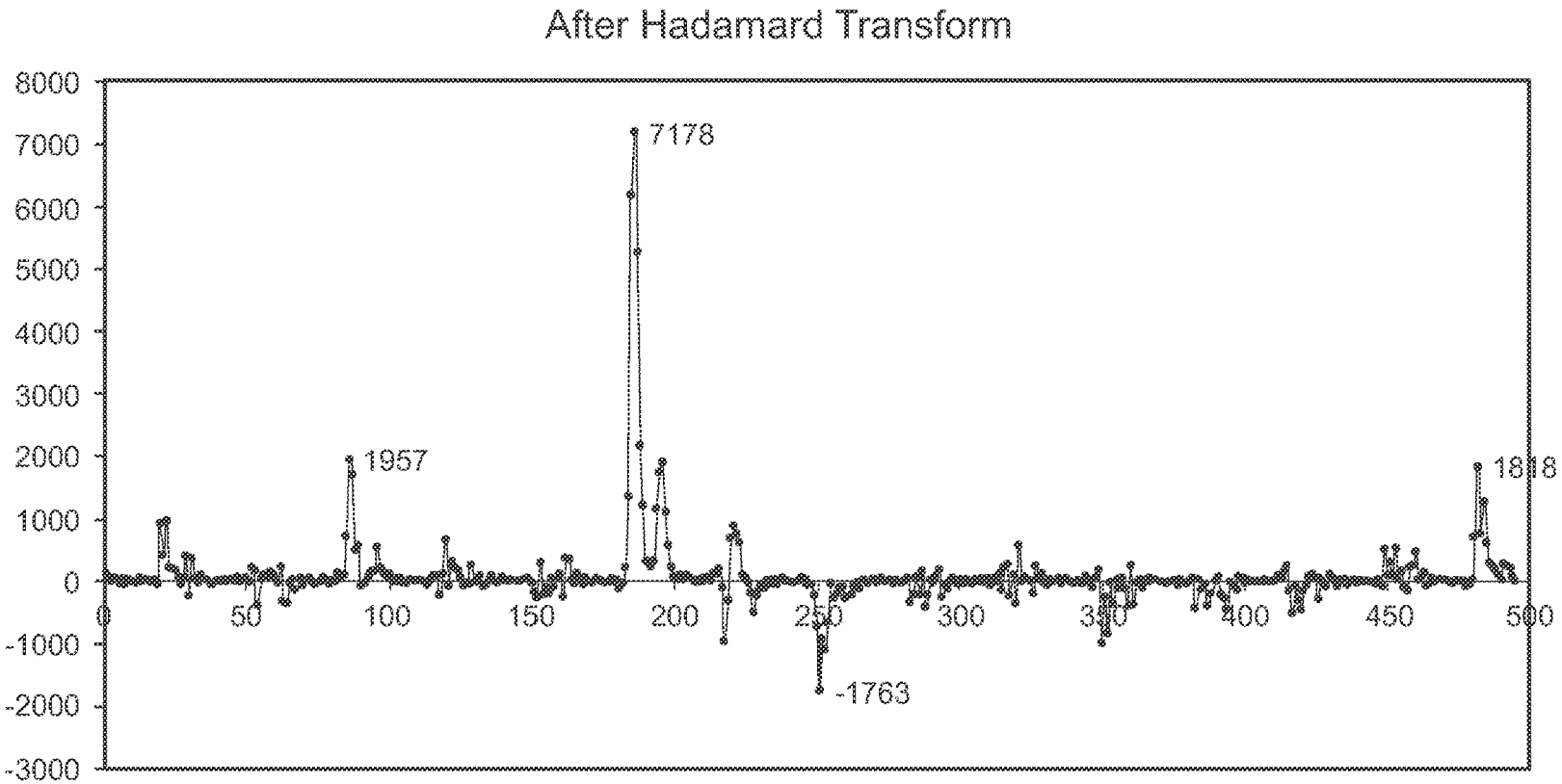
FIG. 8B is a drift spectrum after applying a Hadamard transform in the conventional manner to recover a single drift spectrum from the data of FIG. 8A.
Figure 8C:
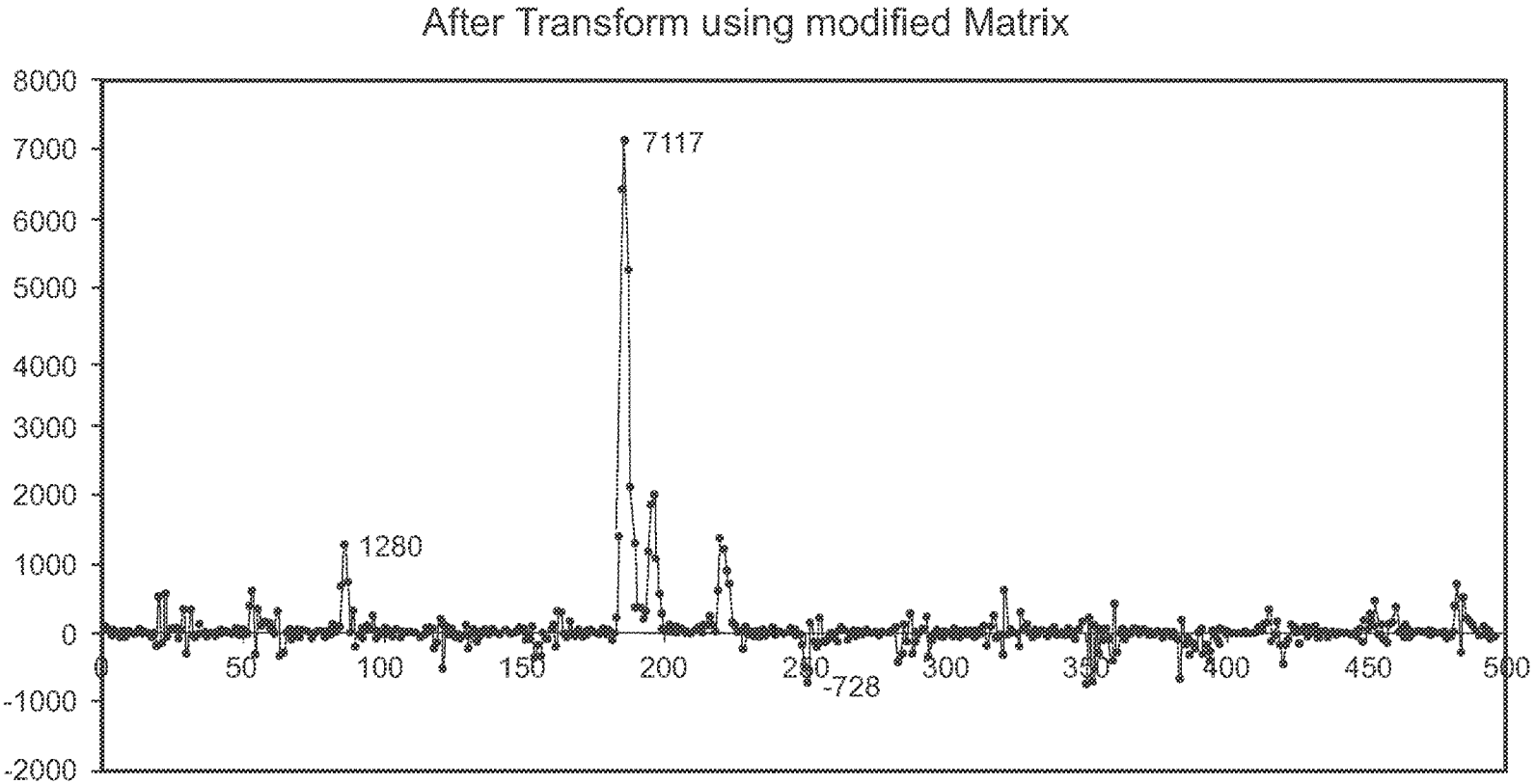
FIG. 8C is a drift spectrum after applying a modified demultiplexing matrix to recover a single drift spectrum from the data of FIG. 8A, in accordance with the present disclosure.

FIG. 8A is an example of a drift spectrum (ion signal intensity as a function of drift time in milliseconds) without (or before) performing deconvolution, i.e., FIG. 8A is a convoluted drift spectrum. FIG. 8B is a drift spectrum after applying a Hadamard transform in the conventional manner to recover a single drift spectrum from the data of FIG. 8A. Multiple noise peaks are clearly visible in the drift spectrum of FIG. 8B. FIG. 8C is a drift spectrum after applying a modified demultiplexing matrix to recover a single drift spectrum from the data of FIG. 8A, in accordance with the present disclosure. In comparison to FIG. 8B, it is seen that the use of the modified demultiplexing matrix is more effective for recovering a single drift spectrum while minimizing noise.

Figure 6:
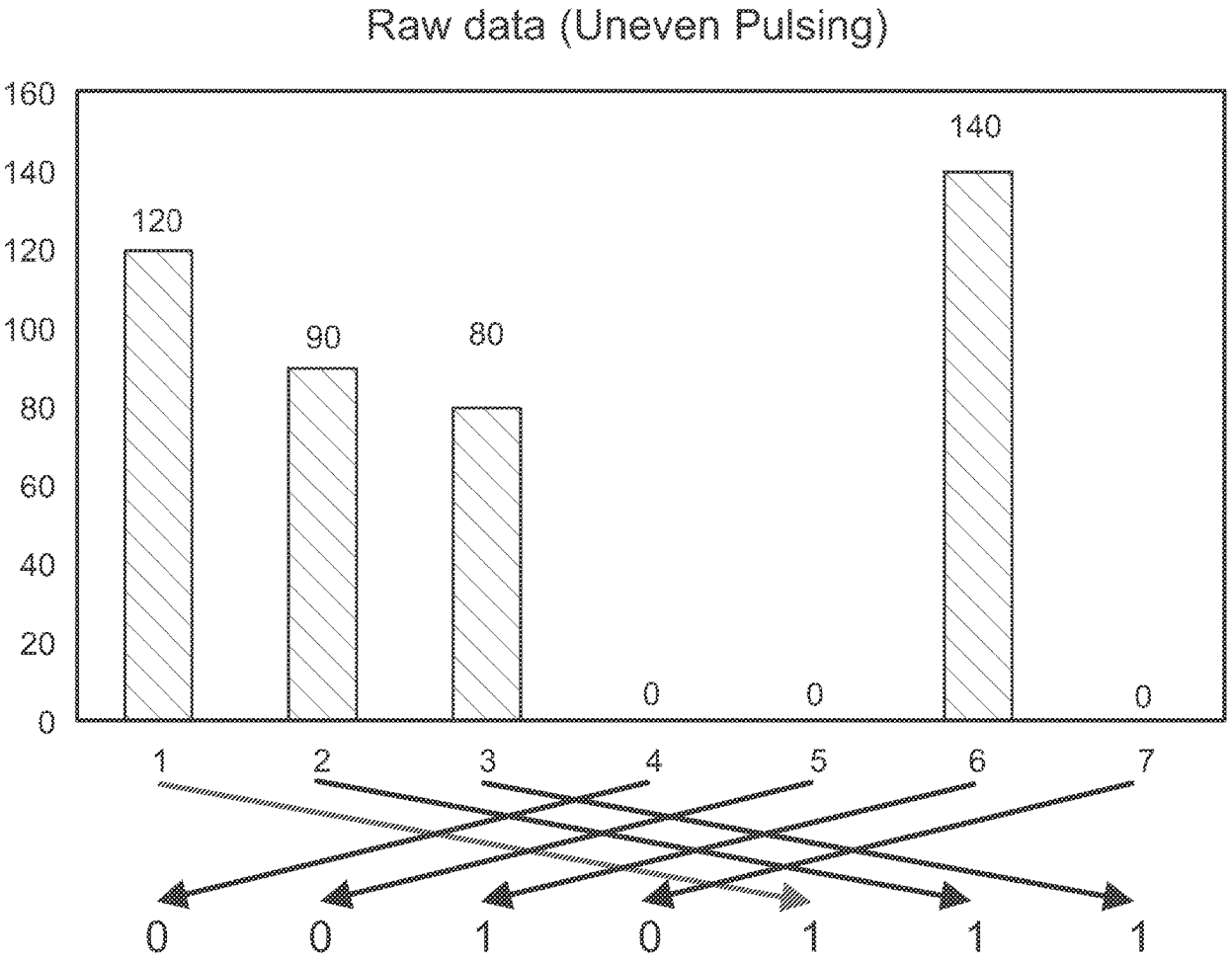
FIG. 6 illustrates the same raw data array as shown in FIG. 4A, but also presents a pulse sequence S below the horizontal axis and illustrates a pattern matching process according to some embodiments.

It will be noted that in the case of an IM-MS system where two-dimensional (2D) data are acquired (both drift time and m/z spectra), the raw data array shown in FIG. 6 (as well as FIGS. 3A and 4A) may represent a single row (linear array) of data points that is part of a 2D N×M array of data points), where N is the number of columns and M is the number of rows of the raw data array. The integer value N is the size (length) of the pulsing sequence, which corresponds to the number drift time blocks as described above in conjunction with FIG. 2. The integer value M is the number of TOF scans per drift time block (i.e., per IM injection event). In examples above and as shown in FIG. 2, a 3-bit PRS (sequence E) results in N=7 drift time blocks (sequence D) across the row (horizontal axis in FIG. 6) and thus seven data points per row, the value of each data point being plotted along the vertical axis in FIG. 6. Also in the example of FIG. 2, twelve TOF scans occur per drift time block (sequence C). Thus in example of FIG. 2, there are N=7 columns and M=12 rows.

Therefore, it will be appreciated that in some embodiments, the methods described herein for determining a demultiplexing matrix and deconvoluting ion measurement data may entail interrogating each row of a 2D array. In such embodiments, a method as described herein may include the step of determining whether all rows have been interrogated. If not, then appropriate steps of the method are repeated for the next row. If all rows have been interrogated, then the method stops.

From the foregoing description, it will be appreciated by persons skilled in the art that the spectrometry system 100 schematically illustrated in FIG. 1A may be reconfigured as an IMS system (e.g., by replacing the MS 116 with a suitable non-mass resolving ion detector) or as a TOFMS system (e.g., by removing the IM device 108, or by operating the IM device 108 as an ion transfer device without a significant buffer gas pressure). From the foregoing description, it will also be appreciated by persons skilled in the art how the methods disclosed herein may be implemented in the context of an IMS system or a TOFMS system.

Exemplary Embodiments

Exemplary embodiments provided in accordance with the presently disclosed subject matter include, but are not limited to, the following:

1. A method for determining a demultiplexing matrix for use in deconvoluting ion measurement data, the method comprising: acquiring ion measurement data comprising positive-value data points and non-positive-value data points; arranging the ion measurement data into a raw data array comprising a pattern of the positive-value data points and the non-positive-value data points, wherein the pattern matches a pattern of ON pulses and OFF pulses of an initial pulse sequence such that the positive-value data points correspond to respective ON pulses and the non-positive-value data points correspond to respective OFF pulses; constructing a modified pulse sequence by replacing each ON pulse of the initial pulse sequence with a corresponding modified ON pulse, wherein each modified ON pulse has a value proportional to the value of the corresponding positive-value data point, and the modified pulse sequence comprises a pattern of modified ON pulses and OFF pulses that matches the pattern of ON pulses and OFF pulses of the initial pulse sequence; and constructing a demultiplexing matrix based on the modified pulse sequence.

2. The method of embodiment 1, comprising obtaining the modified ON pulses by: determining the number of positive-value data points in the raw data array; determining a data point sum by summing the values of the positive-value data points; determining a base abundance by dividing the data point sum by the number of positive-value data points; and dividing the respective values of the positive-value data points by the base abundance to obtain respective values of the modified ON pulses.

3. The method of embodiment 1 or 2, comprising: before arranging the ion measurement data, determining whether the pattern of the positive-value data points and non-positive-value data points can be matched with the pattern of ON pulses and OFF pulses of the initial pulse sequence and, if it is determined that the pattern of the positive-value data points and non-positive-value data points cannot be matched with the pattern of ON pulses and OFF pulses of the initial pulse sequence, then constructing the demultiplexing matrix based on the initial pulse sequence instead of the modified pulse sequence.

4. The method of any of the preceding embodiments, wherein the modified pulse sequence has a length N, and constructing the demultiplexing matrix comprises constructing an N×N matrix based on the modified pulse sequence, and calculating the demultiplexing matrix as an inverse matrix of the N×N matrix.

5. The method of any of the preceding embodiments, wherein each ON pulse of the initial pulse sequence has a binary value of 1 and each OFF pulse of the initial pulse sequence has a binary value of 0.

6. The method of any of the preceding embodiments, wherein the initial pulse sequence is a pseudorandom sequence.

7. The method of any of the preceding embodiments, wherein acquiring ion measurement data comprises injecting ions into a spectrometer at a multiplexed injection rate according to the initial pulse sequence.

8. The method of embodiment 7, comprising injecting the ions into an ion mobility drift cell or a time-of-flight analyzer of the spectrometer 9. The method of any of the preceding embodiments, wherein acquiring ion measurement data comprises operating an ion mobility spectrometer, a time-of-flight mass spectrometer, or an ion mobility-mass spectrometer.

10. A method for deconvoluting ion measurement data, the method comprising: determining a demultiplexing matrix according to the method of any of the preceding embodiments; and applying the demultiplexing matrix to the raw data array to recover ion measurement data corresponding to a single pulsing event.

11. A spectrometry system configured for receiving ion measurement data and performing the method of any of the preceding embodiments.

12. A spectrometry system, comprising: an ion analyzer; an ion detector configured for receiving ions from the ion analyzer; and a computing device configured for receiving ion measurement data from the ion detector and performing the method of any of embodiments 1 to 10.

13. The spectrometry system of embodiment 12, wherein the ion analyzer comprises an ion mobility drift cell, an ion mobility drift cell followed by a mass analyzer, or a time-of-flight analyzer.

14. A system for deconvoluting ion measurement data, the system comprising: a processor and a memory configured for performing the method of any of embodiments 1 to 10.

15. The system of embodiment 14, comprising: a computing device; and an ion detector, wherein the computing device comprises the processor and the memory, and the ion detector is configured for transmitting ion measurement data to the computing device.

16. A computer-readable storage medium comprising instructions for performing the method of any of embodiments 1 to 10.

17. A system comprising the computer-readable storage medium of embodiment 16.

18. A spectrometry system, comprising: an ion analyzer; an ion detector configured for receiving ions from the ion analyzer; and a computing device configured for: receiving, from the ion detector, ion measurement data comprising positive-value data points and non-positive-value data points; arranging the ion measurement data into a raw data array comprising a pattern of the positive-value data points and the non-positive-value data points, wherein the pattern matches a pattern of ON pulses and OFF pulses of an initial pulse sequence such that the positive-value data points correspond to respective ON pulses and the non-positive-value data points correspond to respective OFF pulses; constructing a modified pulse sequence by replacing each ON pulse of the initial pulse sequence with a corresponding modified ON pulse, wherein each modified ON pulse has a value proportional to the value of the corresponding positive-value data point, and the modified pulse sequence comprises a pattern of modified ON pulses and OFF pulses that matches the pattern of ON pulses and OFF pulses of the initial pulse sequence; and constructing a demultiplexing matrix based on the modified pulse sequence.

19. The spectrometry system of embodiment 18, wherein the computing device is configured for obtaining the modified ON pulses by: determining the number of positive-value data points in the raw data array; determining a data point sum by summing the values of the positive-value data points; determining a base abundance by dividing the data point sum by the number of positive-value data points; and dividing the respective values of the positive-value data points by the base abundance to obtain respective values of the modified ON pulses.

20. The spectrometry system of embodiment 18 or 19, wherein the computing device is configured for: before arranging the ion measurement data, determining whether the pattern of the positive-value data points and non-positive-value data points can be matched with the pattern of ON pulses and OFF pulses of the initial pulse sequence and, if it is determined that the pattern of the positive-value data points and non-positive-value data points cannot be matched with the pattern of ON pulses and OFF pulses of the initial pulse sequence, then constructing the demultiplexing matrix based on the initial pulse sequence instead of the modified pulse sequence.

21. The spectrometry system of any of embodiments 18 to 20, wherein the modified pulse sequence has a length N, and constructing the demultiplexing matrix comprises constructing an N×N matrix based on the modified pulse sequence, and calculating the demultiplexing matrix as an inverse matrix of the N×N matrix.

22. The spectrometry system of any of embodiments 18 to 21, wherein each ON pulse of the initial pulse sequence has a binary value of 1 and each OFF pulse of the initial pulse sequence has a binary value of 0.

23. The spectrometry system of any of embodiments 18 to 22, wherein the initial pulse sequence is a pseudorandom sequence.

24. The spectrometry system of any of embodiments 18 to 23, comprising a device configured for injecting ions into the ion analyzer at a multiplexed injection rate according to the initial pulse sequence.

25. The spectrometry system of any of embodiments 18 to 24, wherein the ion analyzer comprises an ion mobility drift cell, an ion mobility drift cell followed by a mass analyzer, or a time-of-flight analyzer.

26. The spectrometry system of any of embodiments 18 to 25, wherein the computing device is configured for deconvoluting ion measurement data by applying the demultiplexing matrix to the raw data array to recover ion measurement data corresponding to a single pulsing event.

27. The spectrometry system of any of embodiments 18 to 26, wherein the computing device comprises a processor and a memory utilized to perform one or more of: receiving the ion measurement data, arranging the ion measurement data, constructing the modified pulse sequence, and constructing the demultiplexing matrix.

Methods for acquiring spectral data from a sample such as described above and illustrated in the Figures may be performed (carried out), for example, in a system that includes a processor and a memory as may be embodied in, for example, a computing device which may communicate with a user input device and/or a user output device. In some embodiments, the system for acquiring spectral data from a sample (or an associated computing device) may be considered as including the user input device and/or the user output device. A spectrometry system such as described above and illustrated in FIG. 1A may include, or be part of, or communicate with a system for acquiring spectral data from a sample. As used herein, the term "perform" or "carry out" may encompass actions such as controlling and/or signal or data transmission. For example, a computing device such as illustrated in FIGS. 1A and 1B, or a processor thereof, may perform a method step by controlling another component involved in performing the method step. Performing or controlling may involve making calculations, or sending and/or receiving signals (e.g., control signals, instructions, measurement signals, parameter values, data, etc.).

As used herein, an "interface" or "user interface" is generally a system by which users interact with a computing device. An interface may include an input (e.g., a user input device) for allowing users to manipulate a computing device, and may include an output (e.g., a user output device) for allowing the system to present information and/or data, indicate the effects of the user's manipulation, etc. An example of an interface on a computing device includes a graphical user interface (GUI) that allows users to interact with programs in more ways than typing. A GUI typically may offer display objects, and visual indicators, as opposed to (or in addition to) text-based interfaces, typed command labels or text navigation to represent information and actions available to a user. For example, an interface may be a display window or display object, which is selectable by a user of a computing device for interaction. The display object may be displayed on a display screen of a computing device and may be selected by and interacted with by a user using the interface. In one non-limiting example, the display of the computing device may be a touch screen, which may display the display icon. The user may depress the area of the touch screen at which the display icon is displayed for selecting the display icon. In another example, the user may use any other suitable interface of a computing device, such as a keypad, to select the display icon or display object. For example, the user may use a track ball or arrow keys for moving a cursor to highlight and select the display object.

It will be understood that one or more of the processes, sub-processes, and process steps described herein may be performed by hardware, firmware, software, or a combination of two or more of the foregoing, on one or more electronic or digitally-controlled devices. The software may reside in a software memory (not shown) in a suitable electronic processing component or system such as, for example, the computing device 118 schematically depicted in FIGS. 1A and 1B. The software memory may include an ordered listing of executable instructions for implementing logical functions (that is, "logic" that may be implemented in digital form such as digital circuitry or source code, or in analog form such as an analog source such as an analog electrical, sound, or video signal). The instructions may be executed within a processing module, which includes, for example, one or more microprocessors, general purpose processors, combinations of processors, digital signal processors (DSPs), or application specific integrated circuits (ASICs). Further, the schematic diagrams describe a logical division of functions having physical (hardware and/or software) implementations that are not limited by architecture or the physical layout of the functions. The examples of systems described herein may be implemented in a variety of configurations and operate as hardware/software components in a single hardware/software unit, or in separate hardware/software units.

The executable instructions may be implemented as a computer program product having instructions stored therein which, when executed by a processing module of an electronic system (e.g., the computing device 118 in FIGS. 1A and 1B), direct the electronic system to carry out the instructions. The computer program product may be selectively embodied in any non-transitory computer-readable storage medium for use by or in connection with an instruction execution system, apparatus, or device, such as an electronic computer-based system, processor-containing system, or other system that may selectively fetch the instructions from the instruction execution system, apparatus, or device and execute the instructions. In the context of this disclosure, a computer-readable storage medium is any non-transitory means that may store the program for use by or in connection with the instruction execution system, apparatus, or device. The non-transitory computer-readable storage medium may selectively be, for example, an electronic, magnetic, optical, electromagnetic, infrared, or semiconductor system, apparatus, or device. A non-exhaustive list of more specific examples of non-transitory computer readable media include: an electrical connection having one or more wires (electronic); a portable computer diskette (magnetic); a random access memory (electronic); a read-only memory (electronic); an erasable programmable read only memory such as, for example, flash memory (electronic); a compact disc memory such as, for example, CD-ROM, CD-R, CD-RW (optical); and digital versatile disc memory, i.e., DVD (optical). Note that the non-transitory computer-readable storage medium may even be paper or another suitable medium upon which the program is printed, as the program may be electronically captured via, for instance, optical scanning of the paper or other medium, then compiled, interpreted, or otherwise processed in a suitable manner if necessary, and then stored in a computer memory or machine memory.

It will also be understood that the term "in signal communication" as used herein means that two or more systems, devices, components, modules, or sub-modules are capable of communicating with each other via signals that travel over some type of signal path. The signals may be communication, power, data, or energy signals, which may communicate information, power, or energy from a first system, device, component, module, or sub-module to a second system, device, component, module, or sub-module along a signal path between the first and second system, device, component, module, or sub-module. The signal paths may include physical, electrical, magnetic, electromagnetic, electrochemical, optical, wired, or wireless connections. The signal paths may also include additional systems, devices, components, modules, or sub-modules between the first and second system, device, component, module, or sub-module.

More generally, terms such as "communicate" and "in . . . communication with" (for example, a first component "communicates with" or "is in communication with" a second component) are used herein to indicate a structural, functional, mechanical, electrical, signal, optical, magnetic, electromagnetic, ionic or fluidic relationship between two or more components or elements. As such, the fact that one component is said to communicate with a second component is not intended to exclude the possibility that additional components may be present between, and/or operatively associated or engaged with, the first and second components.

It will be understood that various aspects or details of the invention may be changed without departing from the scope of the invention. Furthermore, the foregoing description is for the purpose of illustration only, and not for the purpose of limitation—the invention being defined by the claims.

What is claimed is:

1. A method for determining a demultiplexing matrix for use in deconvoluting ion measurement data, the method comprising:

detecting ions to thereby acquire ion measurement data comprising positive-value data points and non-positive-value data points;

arranging the ion measurement data into a raw data array comprising a pattern of the positive-value data points and the non-positive-value data points, wherein the pattern matches a pattern of ON pulses and OFF pulses of an initial pulse sequence such that the positive-value data points correspond to respective ON pulses, and the non-positive-value data points correspond to respective OFF pulses;

constructing a demultiplexing function [S] based on a modified pulse sequence by replacing each ON pulse index value of the initial pulse sequence with a corresponding modified ON pulse index value of a different value than an initial index value, wherein each modified ON pulse has a value proportional to the value of the corresponding positive-value ion signal data point, and the modified pulse sequence comprises a pattern of modified ON pulses and OFF pulses that matches the pattern of ON pulses and OFF pulses of the initial pulse sequence; and constructing a demultiplexing matrix [S] based on the demultiplexing function [S].

2. The method of claim 1, comprising obtaining the modified ON pulses by:

determining the number of positive-value ion signal data points in the raw data array;

determining a data point sum by summing the values of the positive-value ion signal data points;

determining a base abundance by dividing the data point sum by the number of positive-value ion signal data points; and dividing the respective values of the positive-value ion signal data points by the base abundance to obtain respective values of the modified ON pulses.

3. The method of claim 1, comprising:

before arranging the ion measurement data, determining whether the pattern of the positive-value ion signal data points and non-positive-value ion signal data points can be matched with the pattern of ON pulses and OFF pulses of the initial pulse sequence and, if it is determined that the pattern of the positive-value ion signal data points and non-positive-value ion signal data points cannot be matched with the pattern of ON pulses and OFF pulses of the initial pulse sequence, then constructing the demultiplexing matrix based on the initial pulse sequence instead of the modified pulse sequence.

4. The method of claim 1, wherein the modified pulse sequence has a length N, and constructing the demultiplexing matrix comprises constructing an N×N matrix based on the modified pulse sequence, and calculating the demultiplexing matrix as an inverse matrix of the N×N matrix.

5. The method of claim 1, wherein each ON pulse of the initial pulse sequence has a binary value of 1 and each OFF pulse of the initial pulse sequence has a binary value of 0, and the initial pulse sequence is a pseudorandom sequence.

6. The method of claim 1, wherein each ON pulse of the initial pulse sequence corresponds to an ion release event into the ion mobility cell, and a duration of ion accumulation or trapping prior to each ion release event is identical.

7. The method of claim 1, wherein acquiring ion measurement data comprises a step selected from the group consisting of:

injecting ions into a spectrometer at a multiplexed injection rate according to the initial pulse sequence; injecting ions into an ion mobility drift cell; and operating an ion mobility spectrometer or an ion mobility-mass spectrometer.

8. A method for deconvoluting ion measurement data, the method comprising:

determining a demultiplexing matrix according to the method of claim 1; and applying the demultiplexing matrix to the raw data array to recover ion measurement data corresponding to a single pulsing event.

9. A spectrometry system, comprising:

an ion analyzer;

an ion detector configured for receiving ions from the ion analyzer; and a computing device configured for receiving ion measurement data from the ion detector and performing the method of claim 1.

10. The spectrometry system of claim 9, wherein the ion analyzer comprises an ion mobility drift cell or an ion mobility drift cell followed by a mass analyzer.

11. A spectrometry system, comprising:

an ion analyzer;

an ion detector configured for receiving ions from the ion analyzer; and a computing device configured for:

receiving, from the ion detector, ion measurement data comprising positive-value data points and non-positive-value data points;

arranging the ion measurement data into a raw data array comprising a pattern of the positive-value data points and the non-positive-value data points, wherein the pattern matches a pattern of ON pulses and OFF pulses of an initial pulse sequence such that the positive-value data points correspond to respective ON pulses and the non-positive-value data points correspond to respective OFF pulses;

constructing a demultiplexing function [S] based on a modified pulse sequence by replacing each ON pulse index value of the initial pulse sequence with a corresponding modified ON pulse index value of a different value than an initial index value, wherein each modified ON pulse has a value proportional to the value of the corresponding positive-value ion signal data point, and the modified pulse sequence comprises a pattern of modified ON pulses and OFF pulses that matches the pattern of ON pulses and OFF pulses of the initial pulse sequence;

constructing a demultiplexing matrix based on the demultiplexing function [S].

12. The spectrometry system of claim 11, wherein the computing device is configured for obtaining the modified ON pulses by:

determining the number of positive-value ion signal data points in the raw data array;

determining a data point sum by summing the values of the positive-value ion signal data points;

determining a base abundance by dividing the data point sum by the number of positive-value ion signal data points; and dividing the respective values of the positive-value ion signal data points by the base abundance to obtain respective values of the modified ON pulses.

13. The spectrometry system of claim 11, wherein the computing device is configured for:

before arranging the ion measurement data, determining whether the pattern of the positive-value ion signal data points and non-positive-value ion signal data points can be matched with the pattern of ON pulses and OFF pulses of the initial pulse sequence and, if it is determined that the pattern of the positive-value ion signal data points and non-positive-value ion signal data points cannot be matched with the pattern of ON pulses and OFF pulses of the initial pulse sequence, then constructing the demultiplexing matrix based on the initial pulse sequence instead of the modified pulse sequence.

14. The spectrometry system of claim 11, wherein the modified pulse sequence has a length N, and constructing the demultiplexing matrix comprises constructing an N×N matrix based on the modified pulse sequence, and calculating the demultiplexing matrix as an inverse matrix of the N×N matrix.

15. The spectrometry system of claim 11, wherein each ON pulse of the initial pulse sequence has a binary value of 1 and each OFF pulse of the initial pulse sequence has a binary value of 0.

16. The spectrometry system of claim 11, wherein the initial pulse sequence is a pseudorandom sequence.

17. The spectrometry system of claim 11, comprising a device configured for injecting ions into the ion analyzer at a multiplexed injection rate according to the initial pulse sequence.

18. The spectrometry system of claim 11, wherein the ion analyzer comprises an ion mobility drift cell or an ion mobility drift cell followed by a mass analyzer.

19. The spectrometry system of claim 11, wherein the ion analyzer comprises an ion mobility drift cell or an ion mobility drift cell followed): The spectrometry system of claim 11, wherein the computing device is configured for deconvoluting ion measurement data by applying the demultiplexing matrix to the raw data array to recover ion measurement data corresponding to a single pulsing event, and wherein the computing device comprises a processor and a memory utilized to perform one or more of: receiving the ion measurement data, arranging the ion measurement data, constructing the modified pulse sequence, and constructing the demultiplexing matrix.

20. A computer readable storage medium which includes a program which when executed by a processor causes at least the following steps to be performed:

acquiring ion measurement data comprising positive-value data points and non-positive-value data points;

arranging the ion measurement data into a raw data array comprising a pattern of the positive-value data points and the non-positive-value data points, wherein the pattern matches a pattern of ON pulses and OFF pulses of an initial pulse sequence such that the positive-value data points correspond to respective ON pulses, and the non-positive-value data points correspond to respective OFF pulses;

constructing a demultiplexing function [S] based on a modified pulse sequence, by replacing each ON pulse index value of the initial pulse sequence with a corresponding modified ON pulse index value of a different value than an initial index value, wherein each modified ON pulse has a value proportional to the value of the corresponding positive-value ion signal data point, and the modified pulse sequence comprises a pattern of modified ON pulses and OFF pulses that matches the pattern of ON pulses and OFF pulses of the initial pulse sequence; and constructing a demultiplexing matrix based on the demultiplexing function [S].

* * * * *